US010571217B2

(12) United States Patent
Jaegers

(10) Patent No.: US 10,571,217 B2
(45) Date of Patent: Feb. 25, 2020

(54) HANDGUN

(71) Applicant: Helmut Jaegers, Moenchengladbach (DE)

(72) Inventor: Helmut Jaegers, Moenchengladbach (DE)

( * ) Notice: Subject to any disclaimer, the term of this patent is extended or adjusted under 35 U.S.C. 154(b) by 56 days.

(21) Appl. No.: 15/701,462

(22) Filed: Sep. 12, 2017

(65) Prior Publication Data

US 2018/0073834 A1 Mar. 15, 2018

(30) Foreign Application Priority Data

Sep. 13, 2016 (DE) ..... 10 2016 117 184

(51) Int. Cl.

| | |
|---|---|
| ***F41C 3/14*** | (2006.01) |
| ***F41A 3/64*** | (2006.01) |
| ***F41A 17/74*** | (2006.01) |
| ***F41A 19/52*** | (2006.01) |

(52) U.S. Cl.

CPC ..... *F41C 3/14* (2013.01); *F41A 3/64* (2013.01); *F41A 17/74* (2013.01); *F41A 19/52* (2013.01)

(58) Field of Classification Search

CPC .... F41C 3/14; F41A 3/64; F41A 17/74; F41A 19/52; F41A 19/00; F41A 19/14; F41A 19/42; F41A 3/76; F41A 19/53

USPC ..... 42/59, 65–67

See application file for complete search history.

(56) References Cited

U.S. PATENT DOCUMENTS

| | | | | | |
|---|---|---|---|---|---|
| 2,805,604 | A * | 9/1957 | Humphrey | F41A 19/64 | 42/65 |
| 3,049,977 | A * | 8/1962 | Reich | F41A 19/52 | 42/65 |
| 3,470,788 | A * | 10/1969 | Virtanen | F41A 3/76 | 42/59 |
| 3,680,241 | A * | 8/1972 | Ramsay | F41A 17/74 | 102/700 |
| 3,733,730 | A * | 5/1973 | Baker | F41A 19/53 | 42/65 |
| 4,141,165 | A * | 2/1979 | Dichter | F41C 3/14 | 42/59 |
| 4,221,065 | A * | 9/1980 | Curran | F41A 19/13 | 42/59 |
| 4,581,836 | A * | 4/1986 | Baker | F41A 19/13 | 42/65 |
| 4,641,449 | A * | 2/1987 | Kapland | F41C 3/14 | 42/65 |
| 5,220,115 | A * | 6/1993 | Wales | F41C 3/14 | 42/59 |
| 5,613,315 | A * | 3/1997 | Hunziker | F41A 19/13 | 42/65 |
| 5,682,699 | A * | 11/1997 | Gentry | F41A 3/10 | 42/14 |
| 5,724,759 | A * | 3/1998 | Kilham | F41A 17/46 | 42/66 |

(Continued)

FOREIGN PATENT DOCUMENTS

GB 527020 A 10/1940

*Primary Examiner* — Michelle Clement
(74) *Attorney, Agent, or Firm* — Norman B. Thot

(57) ABSTRACT

A handgun includes a barrel which extends in a longitudinal direction, and a breechblock with a breechblock insert. The breechblock insert can be brought into a first state and into a second state where, in the longitudinal direction of the barrel, the second state has a play which is greater than a play in the first state.

14 Claims, 13 Drawing Sheets

(56) References Cited

U.S. PATENT DOCUMENTS 5,826,362 A * 10/1998 Lyons ..... F41A 17/82 42/70.08
6,460,282 B1 * 10/2002 Bustos ..... F41A 19/14 42/66
6,571,502 B1 * 6/2003 Mikuta ..... F41A 19/52 42/65
6,609,323 B1 * 8/2003 Donnelly ..... F41A 3/76 42/59
7,178,443 B2 * 2/2007 Isgen ..... F41A 3/10 89/156
7,861,449 B1 * 1/2011 Zajk ..... F41A 3/66 42/62
7,878,102 B1 * 2/2011 Dubois ..... F41A 3/74 42/65
8,443,537 B2 * 5/2013 Curry ..... F41A 17/72 42/66
9,140,510 B1 * 9/2015 Muska ..... F41A 19/42
9,335,110 B1 * 5/2016 Heizer ..... F41A 19/29
9,518,791 B1 * 12/2016 Heizer ..... F41A 19/29
2003/0192221 A1 * 10/2003 Merlino ..... F41A 17/34 42/66
2005/0028420 A1 * 2/2005 Rossi ..... F41A 17/74 42/70.08
2005/0126062 A1 * 6/2005 Ghisoni ..... F41A 19/52 42/65
2006/0242878 A1 * 11/2006 Dubois ..... F41A 3/74 42/59
2006/0260461 A1 * 11/2006 Rozhkov ..... F41A 3/56 89/194
2009/0044436 A1 * 2/2009 Zajk ..... F41A 3/66 42/59
2009/0044437 A1 * 2/2009 Zajk ..... F41A 19/10 42/65
2010/0192440 A1 * 8/2010 Curry ..... F41C 3/14 42/62
2013/0014634 A1 * 1/2013 Pfersmann ..... F41A 3/74 89/26
2014/0190053 A1 * 7/2014 Zajk ..... F41C 3/14 42/65
2015/0047243 A1 * 2/2015 Tusting ..... F41A 19/52 42/66
2015/0241155 A1 * 8/2015 Heizer ..... F41A 19/23 42/69.03
2015/0330741 A1 * 11/2015 Ghorbani Pour ..... F41A 5/00 89/136
2017/0146311 A1 * 5/2017 Tucker ..... F41A 17/74
2018/0073834 A1 * 3/2018 Jaegers ..... F41A 17/74
2018/0135931 A1 * 5/2018 Cano ..... F41A 19/53

* cited by examiner 5
12
6
16

7
17
18
22
2
14
4
8
1
23
3
10
9
12
11

2
13
100
9
8
11

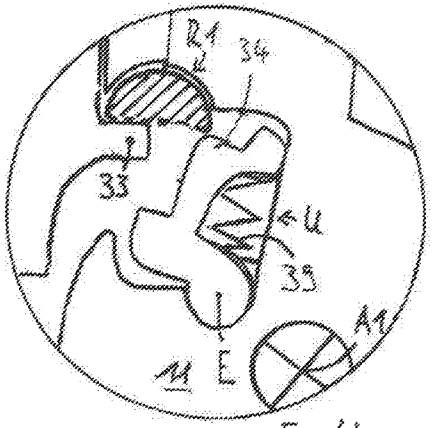
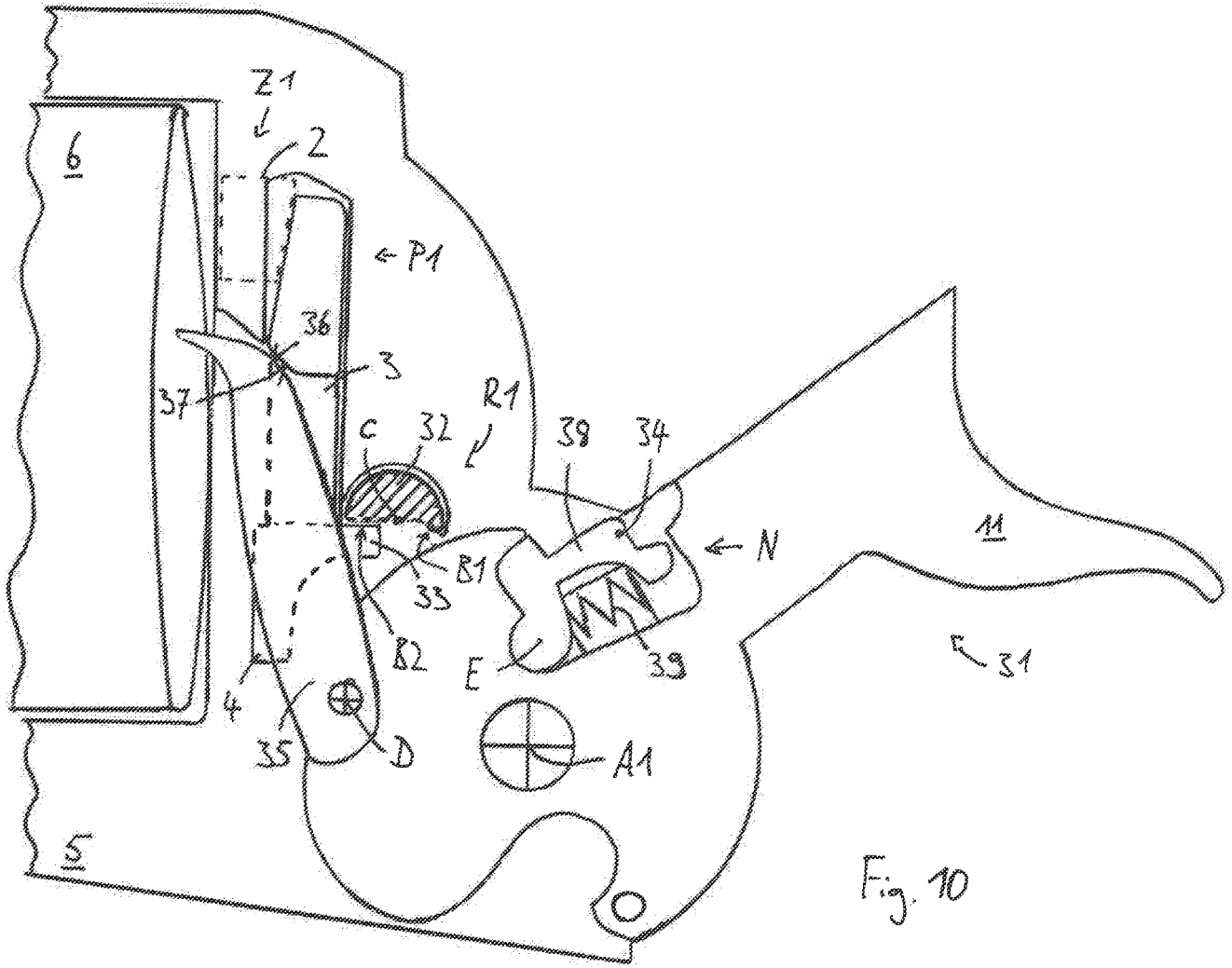
Fig. 10

XIIIa
XIII
A1
P1

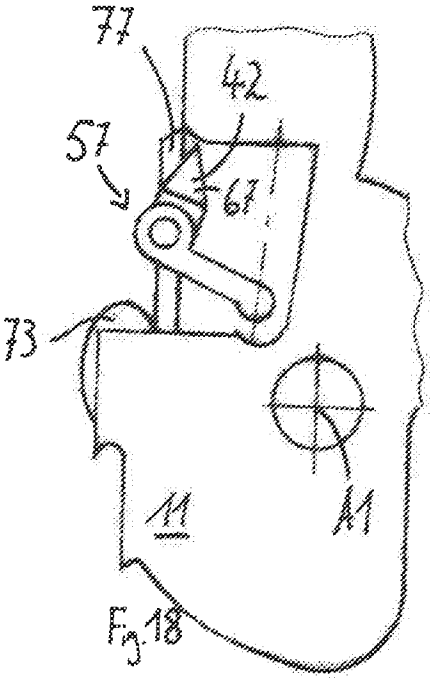
Fig. 18
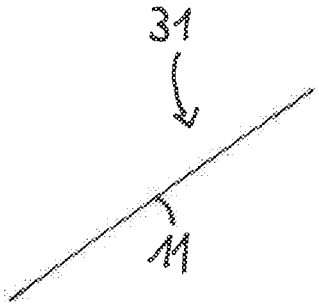
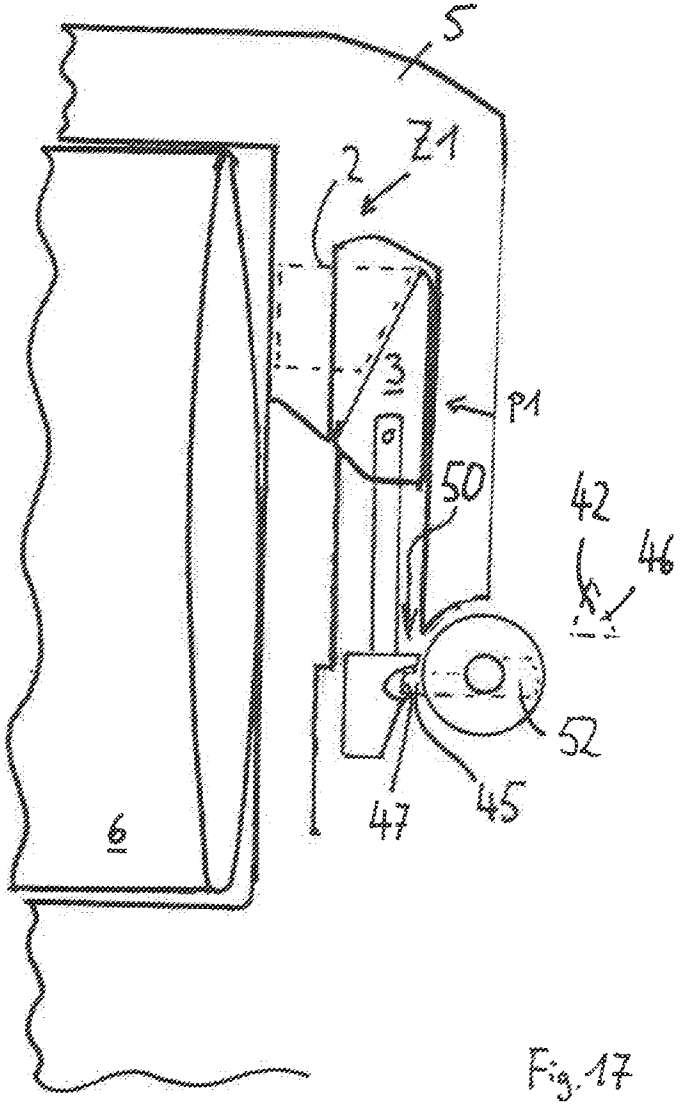
Fig. 17

HANDGUN

CROSS REFERENCE TO PRIOR APPLICATIONS

Priority is claimed to German Patent Application No. DE 10 2016 117 184.0, filed Sep. 13, 2016. The entire disclosure of said application is incorporated by reference herein.

FIELD

The present invention relates to a handgun having a longitudinally extending barrel that has a breechblock.

BACKGROUND

A disadvantage of known handguns of this type is that a displacement relative to the breechblock of the empty shell casing for the purpose of reloading after the shot is often made difficult because the shell casing is compressed against the breechblock with great force and often adheres thereto.

An additional disadvantage of known handguns, in particular in handguns designed as revolvers, is that these often have parts which are potentially breakable.

SUMMARY

An aspect of the present invention is to provide a handgun which is improved at least with respect to one of the above-mentioned disadvantages.

In an embodiment, the present invention provides a handgun which includes a barrel which is configured to extend in a longitudinal direction, and a breechblock comprising a breechblock insert. The breechblock insert is configured to be brought into a first state and into a second state where, in the longitudinal direction of the barrel, the second state has a play which is greater than a play in the first state.

BRIEF DESCRIPTION OF THE DRAWINGS

The present invention is described in greater detail below on the basis of embodiments and of the drawings in which:

FIG. 10 shows a view as in FIG. 7 wherein the hammer is in the shooting position;

FIG. 11 shows a schematic detail view of the projection of the hammer in the retracted state;

FIG. 17 shows an illustration similar to that in FIG. 15 but with the hammer symbolized only by dashed lines in the shooting position;

FIG. 18 shows an illustration of a part of the hammer with the actuation projection in the retracted state;

DETAILED DESCRIPTION

Figure 1:
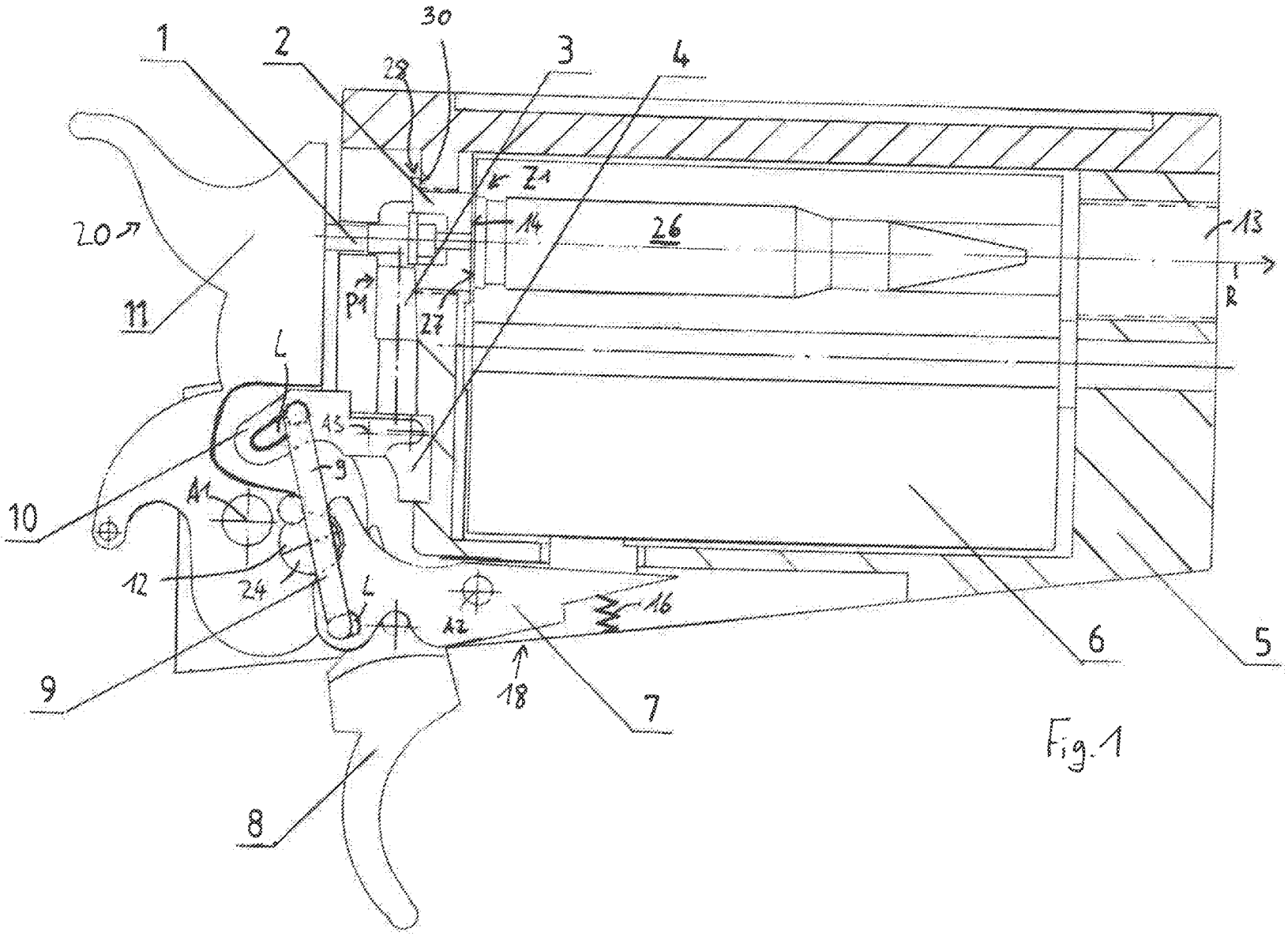
FIG. 1 shows a side cross-section of a part of a first embodiment of a handgun according to the present invention in which the hammer is in a neutral position and the cylinder lock is in a locked position.

The handgun according to the present invention has a barrel that extends in a longitudinal direction. The handgun has a breechblock. The shell casing can, for example, be supported against the breechblock during the shot. During the shot, the breechblock is in contact with the shell casing. A breechblock insert is provided that furnishes the breechblock. The breechblock insert is also abbreviated as the "insert" in the context of this publication. The insert can be brought into a first state and into a second state. The insert has play in the longitudinal direction of the barrel that is greater in the second state than in the first state. The term "play" is to be understood as the insert being displaceable over a limited distance in the longitudinal direction of the barrel.

The handgun can, for example, have a frame. The handgun can, for example, have a trigger. The handgun can, for example, have a hammer. The handgun can comprise a pistol, like an automatic pistol.

The insert can, for example, be brought from the first state into the second state and/or vice-versa. The insert can, for example, include a slide element or is formed thereby.

The insert in the first state can have no play in the longitudinal direction of the barrel or can have a first play in the longitudinal direction of the barrel. In an embodiment, the insert in the first state can, for example, have no play in the longitudinal direction of the barrel. A prerequisite is thereby provided for an effective support of the shell casing during the shot. In the second state, the insert can, for example, have play in the longitudinal direction of the barrel that is less than 1 mm or less than 0.3 mm, or is less than 0.1 mm. In an embodiment, this play is about 0.5 mm or 0.25 mm. In an embodiment, this play is at least 0.05 mm or 0.1 mm or 0.2 mm or 0.5 mm or 0.9 mm. Any bracing between the shell casing and the breechblock is released by increasing or creating play in the second state, and reloading is simplified.

The insert can, for example, be brought into the first state (for example, at least also) during the shot and into the second state (for example, at least also) during the loading. The insert can, for example, be brought from the first state into the second state and/or reversed using actuating elements that are in any event necessary for discharging the shot or for reloading.

The insert can, for example, be brought from the first state into the second state and/or reversed via the hammer.

The insert can, for example, be in the shape of a cylinder having its cylindrical axis, for example, parallel to the longitudinal direction of the barrel. The side of the insert facing the barrel can, for example, furnish the breechblock.

The insert can, for example, be fixed in all directions that are in a plane perpendicular to the longitudinal direction of the barrel, for example, by housing the insert in an opening, for example, of the frame. The insert can, for example, have only precisely one translatory degree of freedom, for example, in the longitudinal direction of the barrel. The insert can, for example, have the form of a circular cylinder. It is possible that it has the form of a cylinder with a base surface that deviates from a circle.

A retaining stop can, for example, be provided that limits the displaceability of the insert in a direction facing the barrel. The retaining stop can, for example, not be changed. A retaining stop surface can, for example, be provided on the insert that, for example, engages with a retaining counter-stop surface, for example, on the frame. The retaining stop can, for example, include a retaining stop projection.

The insert can, for example, engage with a support that can, for example, be mounted in a movable or in a displaceable manner.

A supporting stop can, for example, be provided that limits the displaceability of the insert in the direction facing away from the barrel, and this supporting stop can, for example, be altered. By altering this supporting stop, the insert can, for example, be brought into the first state and into the second state. The supporting stop can, for example, comprise a support or is formed by the support. In the first state of the insert, the position of the insert in which the limitation of movement of the supporting stop is employed can, for example, correspond to the position of the insert in which the limitation of movement of the retaining stop is employed. The insert is, therefore, for example, fixed between these stops and thus, for example, has no play between these stops. In the second state of the insert, the position of the insert in which the limitation of movement of the supporting stop is employed can, for example, not correspond to the position of the insert in which the limitation of movement of the retaining top is employed. The insert can, therefore, for example, move back and forth between these positions and thus, for example, has play between these stops.

The insert can, for example, rest on its side opposite the breechblock against the support. The support can, for example, be moved or displaced relative to the insert. The support can, for example, provide a supporting stop surface. This can, for example, engage with a supporting-stop counter surface of the insert.

The support can, for example, be displaced perpendicular to the longitudinal extension of the barrel, for example, exclusively and further, for example, back and forth. It can, for example, be displaced between 6 mm and 1 mm, for example, about 2.5 mm.

The support is wedge-shaped. In this way an increase and decrease or creation and elimination of play of the insert in the longitudinal extension of the barrel can, for example, be achieved by displacement of the support perpendicular to the longitudinal extension of the barrel.

The support can, for example, have a surface that contacts the insert which is inclined with respect to the longitudinal extension of the barrel at angle $\alpha$. Angle $\alpha$ can, for example, be smaller than the arc tangent of the friction coefficient $\mu$, meaning of the quotients of frictional force and application force between the insert and the support, so that an automatic locking of the support results. The force acting on the support from the shot can, for example, create a force component in the displacement direction of the insert, or in the displacement direction of the support, that is smaller than the static frictional force created as a result. Angle $\alpha$ can, for example, be larger than 1° or 2° or 3° or 4° or 5°. Because the automatic locking must, for example, be overcome by bringing the insert from a first state into a second state, the angle $\alpha$ can, for example, be smaller than the arc tangent of the friction coefficient $\mu$, that is, of the quotients of frictional force and application force between the insert and the support, by a small amount, roughly 1° or 2°.

The supporting stop counter surface of the insert can, for example, be designed complementary to the supporting stop surface of the support.

The hammer can, for example, assume three defined positions, in particular rotational positions, namely, a neutral position, a loading position and a shooting position. In an embodiment, the hammer can have precisely three defined positions or at least three defined positions. The hammer can be manually displaced from the neutral position into the loading position and the shooting position. It can, for example, travel from the shooting position back into the neutral position by a spring force. The term "neutral position" in the context of this publication indicates the position of the hammer that it assumes after a shot is fired, such as during transport of the handgun. In the loading position, the hammer can, for example, be rotated by a first angle with respect to the neutral position. In the shooting position, the hammer can, for example, be rotated by a second angle with respect to the neutral position that is larger than the first angle.

The support can, for example, be changed by displacing the hammer. A displacement device can, for example, be provided for displacing the support. The support can, for example, assume a first position. In this first position, the insert can, for example, be in the first state. The support can, for example, assume a second position. In this second position, the insert can, for example, be in the second state. The support can, for example, be displaced by the displacement of the hammer from the first position into the second position. During tensioning of the hammer from the neutral position into the shooting position, the support can, for example, be displaced one time back and forth, for example, from the first position into the second position and back again. In its first position, the support can, for example, bring the insert into its first state and, for example, the support in its second position brings the insert into its second state.

A tension spring can, for example, act upon the hammer. This can, for example, be arranged between the hammer and the frame. The hammer can, for example, be moved from a neutral position against the force of the tension spring into a loading position. The hammer can, for example, be moved from the loading position against an additional force of the tension spring into a shooting position. After actuation of the trigger, the tension spring can, for example, displace the hammer from the shooting position into its neutral position. In the shooting position of the hammer, the gun can, for example, be ready for firing. Firing a shot can, for example, be performed in the neutral position of the hammer, in which it, for example, actuates the firing pin.

In an embodiment, no device/element is provided that exclusively or primarily serves to displace the insert in a direction away from the barrel. It has been shown that it may be sufficient to configure the insert to be movable only into a second state in which it has a larger play than in the first state.

In an embodiment, no spring acts upon the insert. The insert can, for example, be displaced parallel to the direction of the longitudinal extension of the barrel without a spring force. In an embodiment, no spring, whose spring force runs parallel to the longitudinal extension of the barrel, acts upon the insert.

In an embodiment, the handgun is not designed as automatic or semi-automatic. In an embodiment of the handgun, the energy of the recoil is not, for example, used for the loading procedure.

The handgun can, for example, be a revolver.

The handgun can, for example, be a so-called "single-action" handgun or single-action revolver. Reloading is thus, for example, accomplished by a manual tensioning of the hammer.

The handgun can, for example, comprise a cylinder and, for example, a cylinder lock. A coupling element and a transfer lever can, for example, be provided. The movement of the coupling element can, for example, be transferred to the support using the transfer lever. A locking spring that is arranged between the cylinder lock and the frame, which comprises a compression spring, can, for example, act on the cylinder lock. The movements of the cylinder lock and the transfer lever can, for example, be coupled, for example, via a coupling element. The movement of the transfer lever and of the support is linked, for example, via a transfer element. The transfer lever can, for example, engage with the support via a transfer element. The transfer element can be guided, for example, on the frame. The transfer lever can be mounted on the transfer element in an articulated manner. The transfer element can be designed as one piece with the support. The movement of the cylinder catch and the support can, for example, be coupled, for example, by the coupling element.

In an embodiment, the coupling element is guided, for example, on the frame, so that it can only complete translatory movements. The coupling element can, for example, have a longitudinal direction. The guiding can, for example, be configured so that the coupling element can only complete translatory movements in its longitudinal direction. The coupling element can, for example, have exactly one translatory degree of freedom. The coupling element can, for example, be guided via a groove arranged in the frame. The coupling element can, for example, include a push rod or is formed by a push rod.

During the displacement of the hammer from the neutral position into the loading position, the hammer displaces (for example, via a carrier stop that can, for example, be arranged on the hammer) the cylinder stop, for example, from a locked position of the cylinder lock into a release position of the cylinder lock. In the locked position, the cylinder lock can, for example, lock the cylinder against rotation. In the release position, the cylinder lock can, for example, not lock the cylinder against rotation. Because of the movement coupling between the cylinder lock and the support, the support is thus displaced, for example, from a first position, in which the insert is, for example, in the first state, into a second position, in which the insert is, for example, in the second state.

During the displacement of the hammer from the loading position into the shooting position, the cylinder lock can, for example, slide back into its locked position and locks the cylinder, for example, in a new, further rotated position. Because of the movement coupling between the cylinder lock and the support, the support is thus displaced, for example, from the second position, in which the insert is, for example, in the second state, back into the first position, in which the insert is, for example, in the first state.

The cylinder lock and/or the transfer lever and/or the hammer can, for example, each contain a two-sided lever or are each designed as a two-sided lever. The cylinder lock and/or the transfer lever and/or the hammer are each, for example, rotatably mounted on the frame.

In an embodiment, a transfer element can, for example, be provided that transfers or converts a displacement of the hammer (for example, from its neutral position into its loading position) to the support. This can, for example, be accomplished so that the support is displaced from its first position into its second position. The transfer or conversion can, for example, be accomplished so that the support is translationally displaced, for example, perpendicularly to the longitudinal extension of the barrel.

The transfer element can, for example, be rotatably mounted about an axis, for example, on the frame.

The hammer can, for example, have a projection. The transfer element can, for example, rest against the hammer, for example, with a first region and, for example, against the projection of the hammer.

By the displacement of the hammer (for example, from its neutral position into its loading position) the transfer element can, for example, be rotated about the axis, about which it is rotatably mounted, for example, from a first rotation position into a second rotation position. This can, for example, happen by the application of force from the projection of the hammer onto the first region of the transfer element.

The support can, for example, have a projection. The transfer element can, for example, rest against the support, for example, with a second region and, for example, against the projection of the support.

The transfer element can, for example, displace the support via the second region, for example, by exerting pressure from the second region of the transfer element onto the support, for example, the projection of the support.

The transfer element can, for example, have a cylindrical region. The transfer element can, for example, be rotatably mounted about the axis of this cylindrical region.

The transfer element can, for example, have an at least approximately semi-cylindrical region. The first region of the transfer element can, for example, be arranged on the at least approximately semi-cylindrical region. The second region of the transfer element can, for example, be arranged on the at least approximately semi-cylindrical region.

The projection of the hammer can, for example, be displaced relative to the hammer. The projection can, for example, be displaced between a normal state and a retracted state. In the normal state, a force transmission between the projection of the hammer and the transfer element for displacing the support in order to rotate the transfer element is, for example, possible. In the retracted state, a retraction of the hammer from the shooting position into the neutral position is, for example, possible. A spring can, for example, be provided, against force the force of which the projection can be displaced from its normal state into its retracted state.

The projection of the hammer can, for example, be arranged on a lever that can, for example, be pivotably mounted on the hammer. The lever can, for example, be tensioned with a spring that in the context of this publication is also referred to as a projection spring and which can, for example, be designed as a compression spring.

In an embodiment, a cylinder carrier can, for example, be rotatably mounted about an axis on the hammer. This can be a cylinder carrier, itself known in the art, that rotates the cylinder.

The cylinder carrier can, for example, have a stop surface.

During a displacement of the hammer from its loading position into its shooting position, the cylinder carrier causes a displacement of the support, for example, from a second position, in which the insert can, for example, be in its second state, into a first position, in which the insert can, for example, be in the first state.

The support can, for example, have a shoulder. The cylinder carrier can, for example, press (for example, by a displacement of the hammer from its loading position into its shooting position) its stop surface against this shoulder.

The present invention also relates to a handgun that comprises a hammer. The handgun can, for example, include a cylinder and a cylinder lock. A carrier stop can, for example, be arranged on the hammer. The carrier stop is displaced by a rotation lock, for example, mounted on the hammer in a rotationally fixed manner. This carrier stop, for example, transfers a tensioning of the hammer from a neutral position into a loading position onto the carrier stop so that the latter is displaced from a locked position into a release position. The carrier stop can, for example, be rotationally dependent. This in particular means that the stop effect is dependent upon a specific rotational position of the stop. The carrier stop can, for example, have a cylindrical form. The carrier stop can, for example, have a bevel. The bevel can, for example, divide one of its base surfaces approximately in half. The rotational dependency of the carrier stop can, for example, be caused by the bevel.

The carrier stop can, for example, be displaced against the force of a stop spring, for example, relative to the hammer. The carrier stop can, for example, be displaceable against the force of a stop spring so that it then (for example, temporarily) defects it, thus moving against the spring force of the stop spring, if the hammer changes from its shooting position into its neutral position. The stop spring can, for example, comprise a compression spring and further, for example, acts in the direction of the axis of the cylinder shape of the carrier stop. The stop spring can, for example, act on the base surface of the carrier stop that is opposite the carrier stop and has the bevel. No additional spring action can, for example, be exerted between the cylinder lock and the hammer. The cylinder lock can, for example, rest directly against the carrier stop, for example, without interpositon of a spring.

The carrier stop engages with the cylinder lock, for example, as follows: In the neutral state of the hammer, a section of the outer surface of the non-beveled region of the carrier stop can, for example, rest against a counter-stop surface of the cylinder stop. During tensioning of the hammer from its neutral position into its loading position, the carrier stop can, for example, rotate relative to the cylinder stop. Before reaching the shooting position of the hammer, the carrier stop can, for example, no longer contact the counter-stop surface of the cylinder lock with its high region (in the non-beveled region), but can, for example, turn its bevel toward the cylinder stop so that the counter-stop surface of the cylinder stop, for example, slides along this bevel and the cylinder lock is, for example, rotated back into its locked position by the stop spring. After actuation of the trigger, the hammer can, for example, rotate into its neutral position. The carrier stop thus, for example, slides with its bevel against the cylinder lock and can, for example, be displaced by it against the force of the stop spring. As soon as the carrier stop has slid past against the contact region of the cylinder lock, the stop spring can, for example, displace it back again and the carrier stop is, for example, again positioned with its outer surface engaged with the counter-stop surface of the cylinder lock.

In its first position, the support can, for example, cause the insert to be in its first state. In its second position, the support can, for example, cause the insert to be in its second state.

As already mentioned above, the support can, for example, have a surface that contacts the insert and is inclined at an angle $\alpha$ with respect to the longitudinal extension of the barrel. The contact surface can also be described as a supporting stop surface. The angle $\alpha$, which in an embodiment also occupies the contact surface in the displacement direction of the support, in an embodiment is larger than the arc tangent of the friction coefficient $\mu$, meaning of the quotients of frictional force and application force between the insert and the support so that no automatic locking of the support results. The force acting on the support from the shot can, for example, cause a force component in the displacement direction of the support that is greater than the resulting static frictional force. The support can thereby be prevented from clamping so strongly that a tensioning of the hammer is prevented. Angle $\alpha$ can, for example, be between 10° and 40°, or between 15° and 35° and, for example, is about 25°. Because the force operating on the support from the shot can, for example, cause a force component in the displacement direction of the support that is greater than the resulting static frictional force, a blocking element can, for example, be provided, particularly in this embodiment, that prevent a displacement of the support by forces acting during the firing of the shot.

In an embodiment, a blocking element is provided that can, for example, lock the support in its first position and, for example, temporarily. The term "temporarily" in particular means that the blocking can be canceled and restored.

The blocking element can, for example, comprise a blocking stop that can be activated and deactivated. The blocking stop can, for example, be deactivated during the loading process and can also, for example, be activated during the firing of the shot. The blocking stop can, for example, be designed so that its activation and deactivation is accomplished by the displacement of an element of the blocking stop, for example, a safety bolt.

In an embodiment, the blocking stop comprises a safety bolt. The safety bolt can, for example, be displaced into an engagement position and a disengagement position. The safety bolt can, for example, be held in the engagement position by a bolt spring. An actuation projection can, for example, be arranged on the hammer, for example, for displacing the safety bolt. The actuating stop can, for example, deactivate the blocking stop, for example, during a tensioning of the hammer. The actuation projection can, for example, displace or presses the safety bolt during a tensioning of the hammer into the disengaged position. In the engaged position of the safety bolt, the blocking stop can, for example, be activated. In the disengaged position of the safety bolt, the blocking stop can, for example, be deactivated. In an embodiment, a tensioning of the hammer (for example, out of its neutral position into its loading position) causes a displacement of the safety bolt out of its engaged position into the disengaged position. In an embodiment, a tensioning of the hammer (for example, out of its loading position into its neutral position) causes a displacement of the safety bolt out of its disengaged position into its engaged position. In an embodiment, the actuation projection of the hammer then presses the safety bolt out of the engaged position into the disengaged position if the hammer is tensioned from it neutral position into the loading position.

This has as a result, for example, that the support can cause the breechblock insert to be in its second state during the loading process so that the loading process can run smoothly and the support can cause the breechblock to be in its first state during the loading process and is safely held in this state by the blocked support during the firing of the shot.

The bolt spring can, for example, press the safety bolt back into the engaged position if the hammer is tensioned out of its loading position into the shooting position.

The blocking stop can, for example, comprise a blocking stop surface and a blocking stop counter surface. The blocking stop surface can, for example, be arranged on the safety bolt. In the engaged position of the safety bolt, the blocking stop can, for example, block the support by striking the blocking stop surface against the blocking stop counter surface. The blocking stop counter surface can, for example, be arranged on the support of one of the elements connected to the support. The blocking stop counter surface can, for example, be arranged on the transfer element.

In an embodiment, the safety bolt can, for example, be displaceably arranged directly in a hole of the frame. The safety bolt can have a cylindrical base shape. It can have a cut-out on its side facing the support for forming a stop surface. It can be arranged rotationally locked within the frame. It can have a cut-out on its side facing the support for forming a contact surface with the actuation projection of the hammer.

In an embodiment, the blocking stop can, for example, be designed so that it can only be activated in the first position of the support. In the embodiment having a safety bolt, its return from its disengaged position into the engaged position is only possible in the first position of the support.

In an embodiment, during a tensioning of the hammer out of its neutral position into the loading position, the actuation projection can, for example, push the safety bolt out of its engaged position into its disengaged position. The safety bolt can, for example, be prevented from returning from its disengaged position into the engaged position if the support is still in its second position. This can, for example, be achieved by the blocking-stop counter surface (which, for example, engages with the blocking stop surface that is, for example, arranged on the safety bolt) being arranged exclusively so that it allows a return of the safety bolt if the support element is in its first position.

In an embodiment, the blocking element includes a locking pin that can, for example, be arranged on the hammer. This locking pin (for example, in the neutral position of the hammer) blocks the support, for example, by blocking the transfer lever. As soon as the hammer is tensioned out of its neutral position, the locking pin can, for example, no longer block the transfer lever and prevents the support from being displaced from its first position into its second position.

In an embodiment, the gun can be brought into a locked state. In this state, the hammer can, for example, be prevented from displacing itself into its neutral position. The hammer is thereby, for example, prevented from activating the firing pin and firing a shot. In the locked state of the gun, a retaining stop can, for example, be activated that prevents the hammer from displacing itself into its neutral position. The retaining stop can, for example, be arranged between the hammer and the frame of the gun in the locked state. The retaining stop can, for example, be designed as a sliding safety catch. The sliding safety catch can, for example, be slidably mounted on the hammer.

In an embodiment, the retaining stop can, for example, be activated by a tensioning (for example, by a small degree, for example, around 10°) of the hammer, for example, by a projection of the trigger sliding along the sliding safety catch during tensioning until it comes into abutment with the sliding safety catch and, for example, displaces it. In an embodiment, the retaining stop can, for example, be activated during a tensioning of the hammer (for example, by a small degree, for example, around 10°) and subsequent relief of the hammer, for example, by a projection of the trigger sliding along the sliding safety catch during tensioning until it comes into contact with the sliding safety catch and it is further, for example, displaced by a relaxing of the hammer.

The present invention is explained in greater detail below under reference to exemplary embodiments as shown in the drawings.

Figure 4:
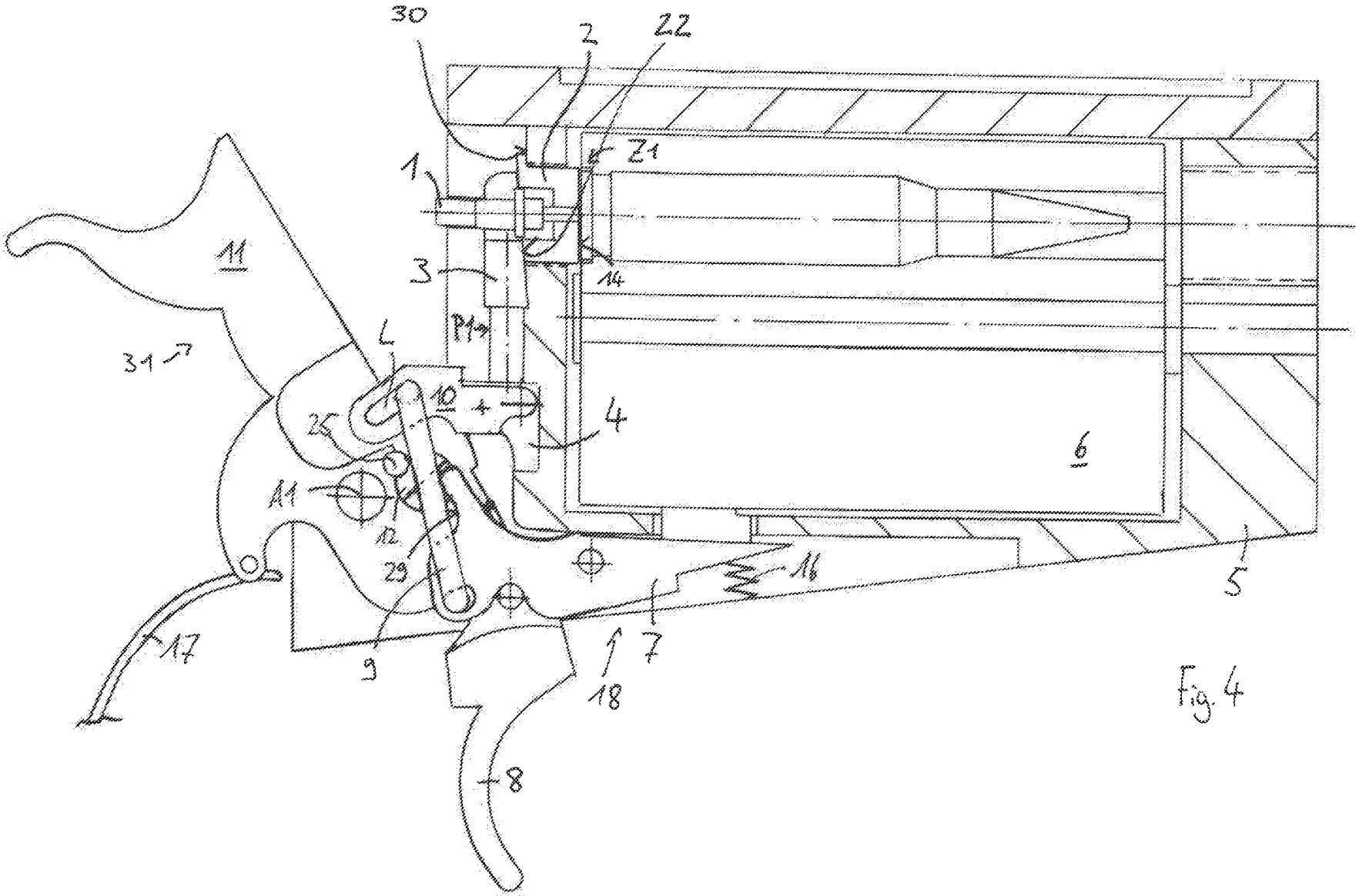
FIG. 4 shows an illustration as in FIG. 1 wherein the hammer is in the shooting position and the cylinder lock is in the locked position.
Figure 5:
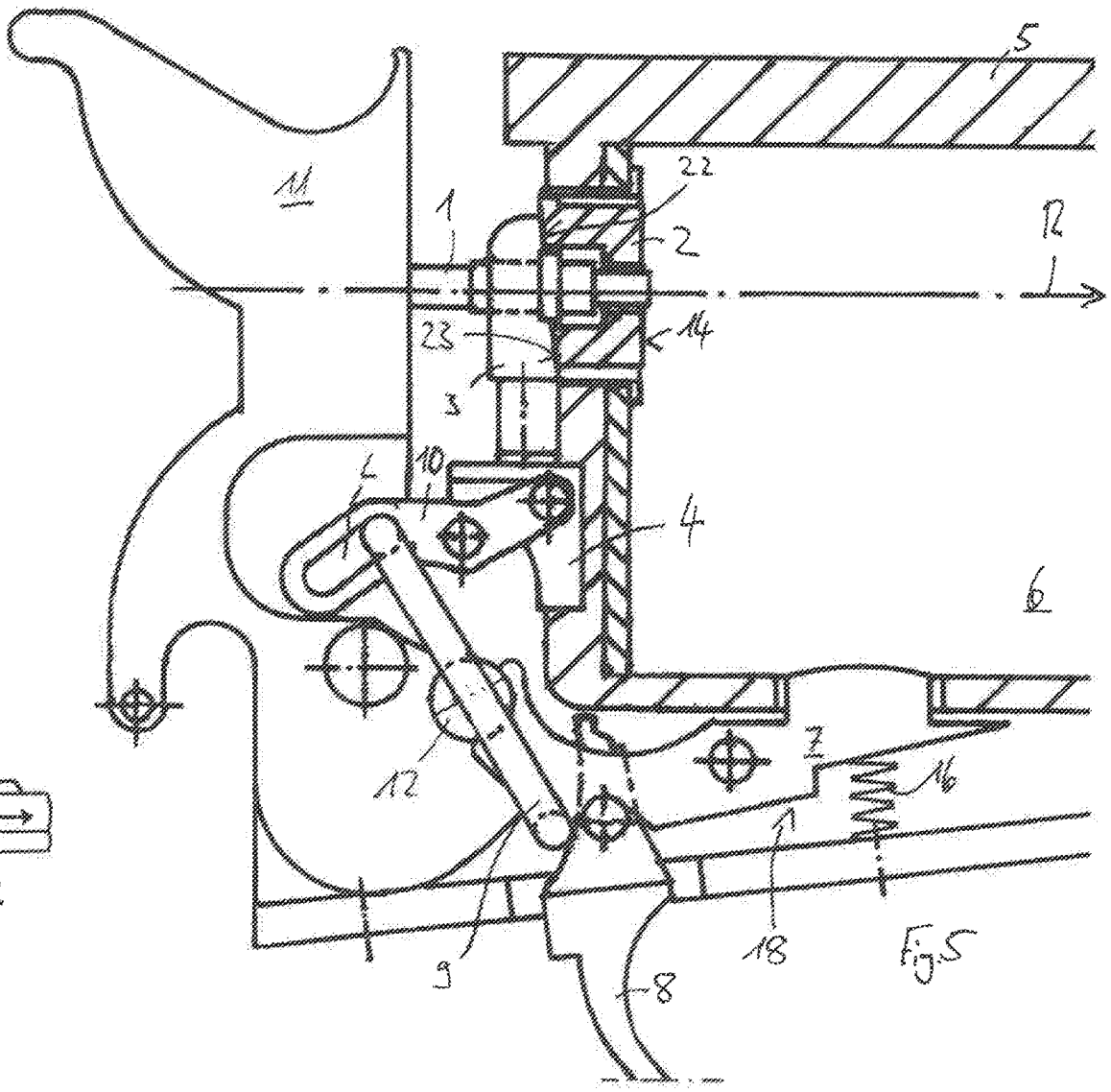
FIG. 5 shows an illustration as in FIG. 1 of a second embodiment of the present invention.
Figure 6:
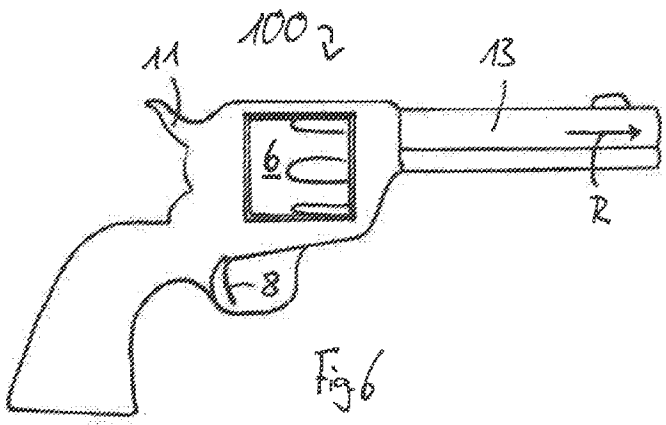
FIG. 6 shows the external contours of the handgun in all the exemplary embodiments.
Figure 8:
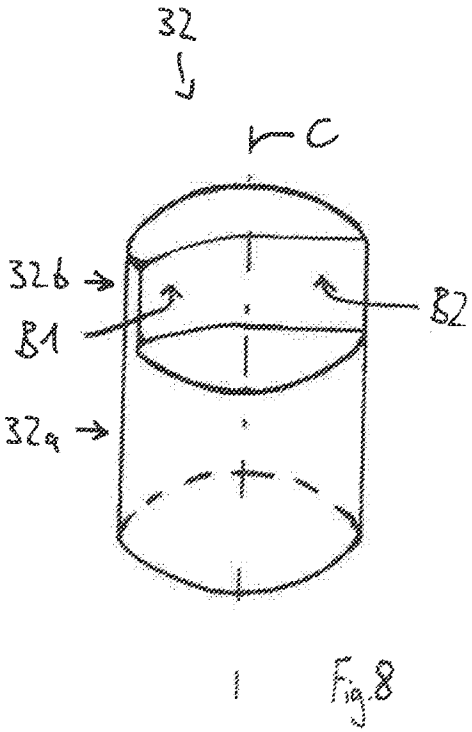
FIG. 8 shows a schematic perspective representation of the transfer device from FIG. 7 on a larger scale.

The first embodiment of the handgun according to the present invention shown in FIGS. 1 to 4 differs from the second embodiment of the handgun shown in FIG. 5 only in that the individual parts are shaped slightly differently. In all the examples described, the whole gun, indicated as 100, is designed as a revolver, as it is shown schematically in FIG. 6.

The following embodiments apply to all exemplary embodiments described, unless otherwise indicated.

FIG. 1 roughly shows, for example, that the handgun has a barrel 13 that extends in a longitudinal direction R. This barrel can also be clearly seen in FIG. 6. The revolver has a cylinder 6 in which a plurality of cartridges 26 (only one is visible in FIG. 1) are arranged. The handgun has a frame 5, on which a hammer 11 is rotatably mounted. A cylinder lock 7 is provided that can, for example, be rotatably mounted on frame 5. Handgun 100 has a firing pin 1 which can be struck by hammer 11 against base 27 of cartridge 26 and thus cause a shot to fire. Cylinder 6 is rotatably mounted in frame 5 of the revolver. It can be blocked by cylinder lock 7. A trigger 8 having a projection 78 is provided. Trigger 8 is, for example, rotatably mounted on frame 5. Hammer 11 has two notches K1, K2, into which trigger 8 can engage via its projection 78 and thereby define the rotational position of hammer 11. A tension spring 17 acts on hammer 11 (see FIG. 4). Hammer 11 is rotatably mounted about an axis A1 on frame 5. As shown in FIG. 4, spring 17 causes an upwards force on hammer 11 and, with it, a clockwise torque.

Figures 2, 3:
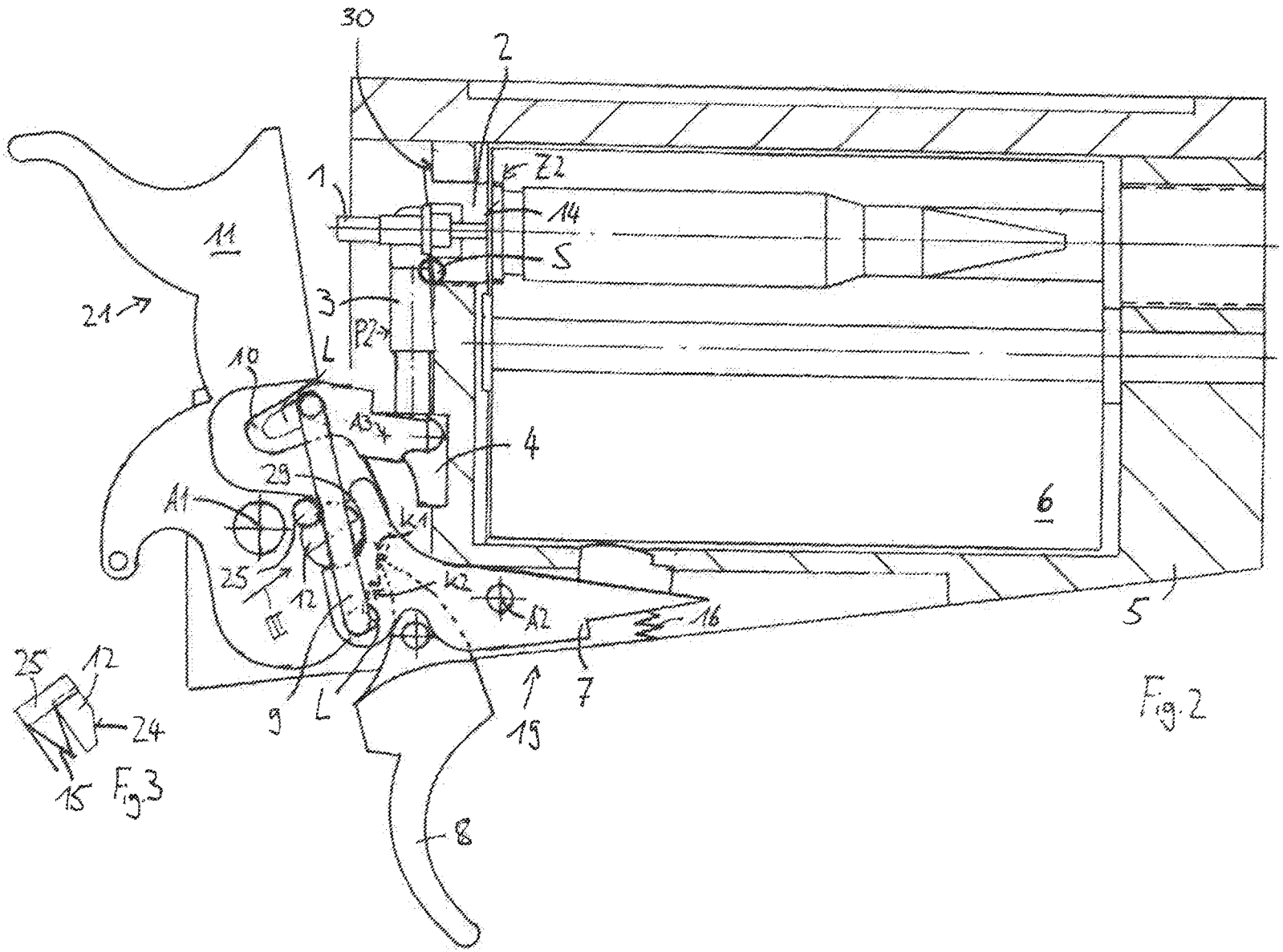
FIG. 2 shows an illustration as in FIG. 1 in which the hammer is in loading position and the cylinder lock is in the release position.
FIG. 3 shows a side view of the carrier stop as viewed along the arrow III in FIG. 2 with a stop spring and a rotation lock.

The handgun 100 further has a breechblock 14 that is provided with a breechblock insert 2. Breechblock insert 2 is cylindrical, having a circle as a base surface and has a retaining stop 28 that limits its displaceability in the direction of the barrel 13. Insert 2 can be brought into a first state Z1 (see FIG. 1) and into a second state Z2 (see FIG. 2). The play S of insert 2 in longitudinal direction R of barrel 13 is larger in second state Z2 than in first state Z1. A comparison of FIGS. 1 and 2 shows that insert 2 in first state Z1 has no play in the longitudinal direction R of barrel 13, while in second state Z2 (FIG. 2), play S is present in longitudinal direction R of barrel 13. This play is about 0.25 mm in the shown embodiment. Retaining stop 28 cannot be changed. Retaining stop 28 includes a retaining stop projection. While the movability of insert 2 toward barrel 13 (according to FIGS. 1 and 2 to the right) is limited by retaining stop 28, it is limited in the opposite direction by a support 3, which can also be described as a bolt and against which insert 2 directly rests with its side opposite the breechblock 14, for example, in first state Z1 of the insert. Support 3 provides a support surface 22. This engages with a supporting-stop counter surface 23 of insert 2. In FIG. 1, support 3 is shown in its first position P1. In FIG. 2, support 3 is shown in its second position P2. A retaining stop surface is provided on insert 2 that engages with a retaining counter-stop surface 30 on the frame. As can be clearly seen in FIG. 5, support 3 can be displaced perpendicularly to longitudinal direction R of barrel 13 and, in FIGS. 1, 2, 4 and 5, specifically up and down. Among others, FIGS. 1 and 5 also show that support 3 is wedge-shaped. Its supporting stop surface 22 facing insert 2 is formed obliquely and the supporting-stop counter surface 23 of insert 2 that contacts it has a complementary bevel. The supporting member is supported in the frame against displacement in the direction facing insert 2. In FIGS. 1, 2, 4 and 5, its displacement leads upwards, thus to a decrease and finally an elimination of play S of insert 2 between supporting-stop counter surface 30 and supporting stop surface 22. This displacement of support 3 takes place via a manual actuation of hammer 11 from its neutral position 20 into its loading position 21.

For this purpose, a carrier stop is arranged on hammer 11 in the two first embodiments. Its stop surface engages into a counter-stop surface 29 arranged on cylinder lock 7. Cylinder lock 7 is rotatably mounted on the frame about an axis A2. A tensioning of hammer 11 from neutral position 20 into its loading position 21 sets cylinder stop 7 into a rotation out of its blocked position 18 (FIG. 1) into its release position 19 (FIG. 2). This rotation of cylinder lock 7 is transmitted in the two first embodiments through a coupling element 9, which is executed as a push rod, onto a transfer lever 10. Transfer lever 10 can also be described as a carrier lever. Hammer 11, cylinder lock 7 and transfer lever 10 are designed as two-sided levers. Transfer lever 10 is rotatably mounted on the frame about an axis A3. The movements of cylinder stop 7 and transfer lever 10 are linked together by coupling element 9. Because coupling element 9 is guided so that it can only perform a translatory movement in the direction of its longitudinal extension, elongated holes L are necessary in cylinder lock 7 and in transfer lever 10. A rotation of the cylinder lock is therefore transmitted into a corresponding rotation of transfer lever 10. If transfer lever 10 rotates clockwise, as is shown in FIGS. 1 and 2, it then pulls transfer element 4 downwards and, with it, support 3 that is attached thereto. To do this, transfer lever 10 engages a pin provided thereon into a cut-out of transfer element 4, for example, essentially without play. This results in play S indicated in FIG. 2. Any bracing between the shell casing base and breechblock 14 that could possibly arise during the shot is released, and reloading, in the case of the revolver described, the further rotation of the cylinder, can be carried out without a problem. Cylinder lock 7, coupling element 9 and transfer lever 10 can be described as a displacement device.

The embodiment shown in FIG. 5 differs from the embodiment described in FIGS. 1, 2 and 4 specifically in that transfer lever 10 has a somewhat different shape.

The carrier stop 12 has a cylindrical shape. It is spring-loaded by stop spring 15. Carrier stop 12 has a bevel 24 (see FIG. 3). Bevel 24 divides its base surface about in half. Stop spring 15 comprises a compression spring and acts in the direction of the axis of the cylinder shape of carrier stop 12. Stop spring 15 acts on the base surface of carrier stop 12 that is opposite the carrier stop that has bevel 24. No additional spring can, for example, act between cylinder lock 7 and hammer 11. Cylinder lock 7 rests directly against carrier stop 12 without interposition of a spring. Carrier stop 12 engages with cylinder lock 7, for example, as follows: In the neutral state, a region of the outer surface of the non-beveled region of the carrier stop rests on a counter-stop surface 29 of cylinder lock 7. Carrier stop 12 is displaced by a rotation lock 25 mounted on hammer 11 in a rotationally fixed manner. During tensioning of hammer 11, carrier stop 12 rotates relative to cylinder lock 7. Before reaching the shooting position of hammer 11 described in FIG. 4, carrier stop 12 no longer contacts the counter-stop surface 29 with its high region (in the non-beveled region) of the cylinder lock, but rotates its bevel 24 to the cylinder lock so that counter-stop surface 29 of the cylinder lock slides along this bevel and cylinder lock 7 is rotated back into its locked position by the stop spring 15 (see FIG. 4). After actuation of trigger 8, the hammer in FIG. 4 rotates clockwise and carrier stop 12 moves down in FIG. 4. It thus slides along with its bevel 24 on cylinder lock 7 and is displaced by it against the force of stop spring 15. As soon as carrier stop 12 has slid past on the contact region of cylinder lock 7, stop spring 15 displaces it back again and carrier stop 12 is again positioned having its outer surface engaged with counter-stop surface 29 of cylinder lock 7.

In the third embodiment shown in FIGS. 7 to 11, an additional possibility is shown for displacing support 3 back and forth during tensioning of hammer 11. This possibility can be realized alternatively or additionally to the possibility described above in connection to the first two embodiments.

For this purpose, a transfer element 32 is provided in the third embodiment that transfers or converts a displacement of hammer 11 from its neutral position 20 (FIG. 7) into its loading position 21 (FIG. 9) onto support 3. This is accomplished so that the support 3 is thereby displaced from its first position P1 into its second position P2.

Transfer member 32 can, for example, have a cylindrical region 32*a* about whose axis C it is rotatably mounted on frame 5. It also has one at least semi-cylindrical region 32*b* (see FIG. 8). It rests with a first region B1 of semi-cylindrical region 32*b* on a projection 34 of the hammer 11. By the displacement of hammer 11 from its neutral position 20 into its loading position 21, transfer member 32 is rotated about axis C from a first rotational position R1 shown in FIG. 7 into a second rotational position R2 shown in FIG. 9, namely, by the application of force from projection 34 of the hammer 11 onto first region B1 of transfer member 32.

Figure 9:
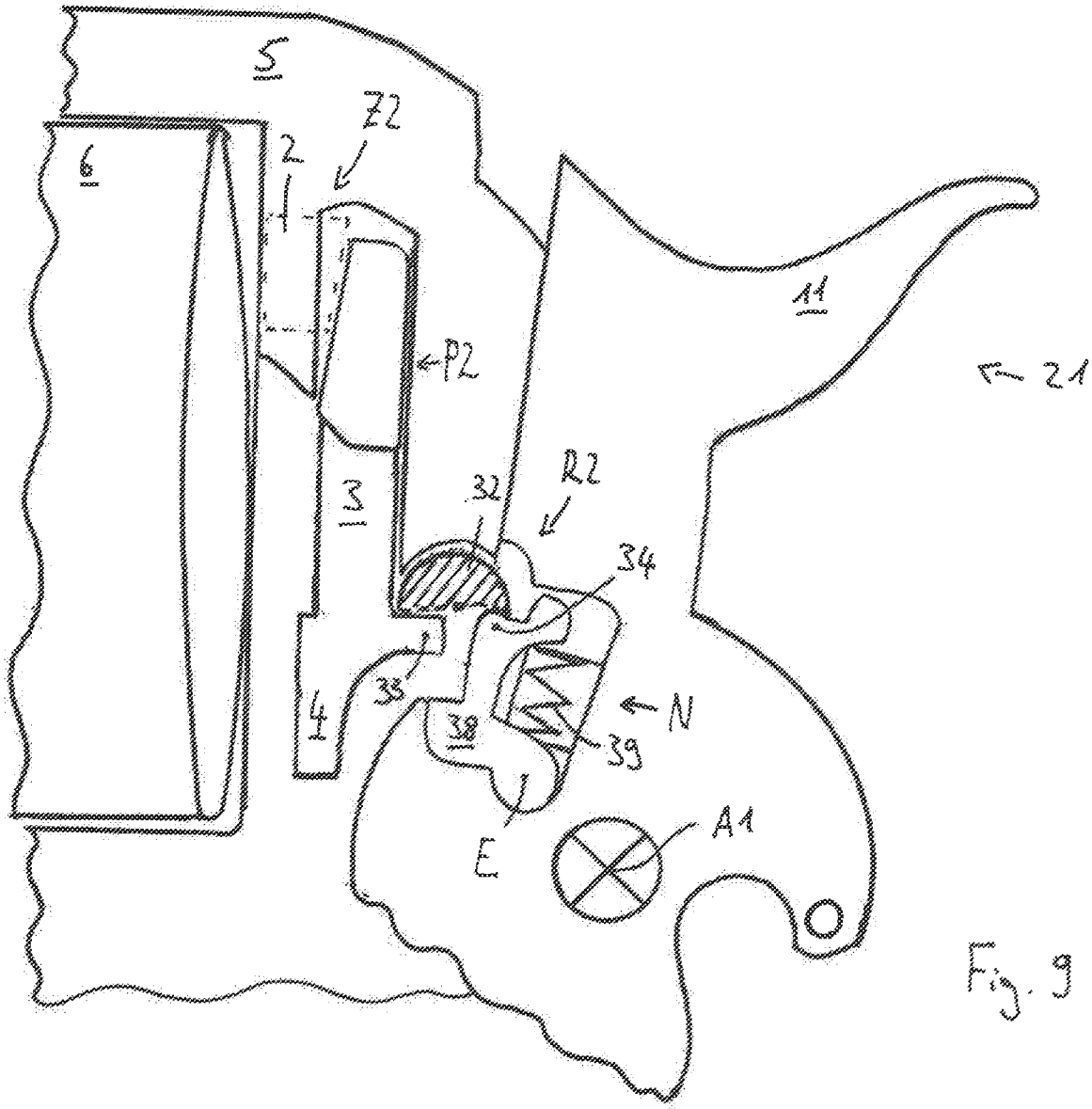
FIG. 9 shows a view as in FIG. 7 in which the hammer is, however, in the loading position.

Projection 34 of hammer 11 can be displaced between a normal state N and a retracted state U relative to hammer 11 (compare, for example, FIGS. 9 and 11). This takes into account that, during tensioning of hammer 11, projection 34 of hammer 11 leaves transfer member 32 in its second rotational position R2, whereas during the displacement of hammer 11 back from shooting position 31 into its neutral position 20, projection 34 must pass transfer member 32 if the latter is located in its first rotational position R1 (see, for example, FIGS. 10 and 11). In retracted state U of projection 34, a return of hammer 11 from the shooting position into the neutral position is possible. A projection spring 39 can, for example, be provided against the force of which the projection 34 can be displaced from its normal state N into its retracted state U.

Projection 34 of hammer 11 can, for example, be arranged on a lever 38 which is, for example, pivotably mounted about an axis E on hammer 11. Lever 38 can, for example, be loaded by projection spring 39, which is designed as a compression spring.

Transfer member 32 rests with a second region B2 of its semi-cylindrical region 32*b* on a projection 33 of support 3. Using region B2, transfer member 32 displaces support 3 by the application of force on projection 33 of the support 3.

As FIG. 10 shows, in the third exemplary embodiment, a cylinder carrier 35 is rotatably mounted on the hammer about an axis D. For better clarity, this cylinder carrier 35 is not graphically depicted in FIGS. 7 and 9. The cylinder carrier 35 turns cylinder 6. It is also present in the first two shown embodiments.

In the third embodiment, however, cylinder carrier 35 assumes an additional function, namely (if necessary, in addition to cylinder lock 7 and coupling element 9 and transfer lever 10 that also assumes this function) the displacement of support 3 from second position P2 back into first position P1. To do this, cylinder carrier 35 has a stop surface 36. During a displacement of hammer 11 from its loading position 21 into its shooting position 31, cylinder carrier 35 causes a displacement of support 3 from second position P2 into first position P1. Support 3 has a support shoulder 37 therefor. During a displacement of hammer 11 from its loading position 21 into its shooting position 31, cylinder carrier 35 presses against this support shoulder 37 with its stop surface 36.

Figure 20:
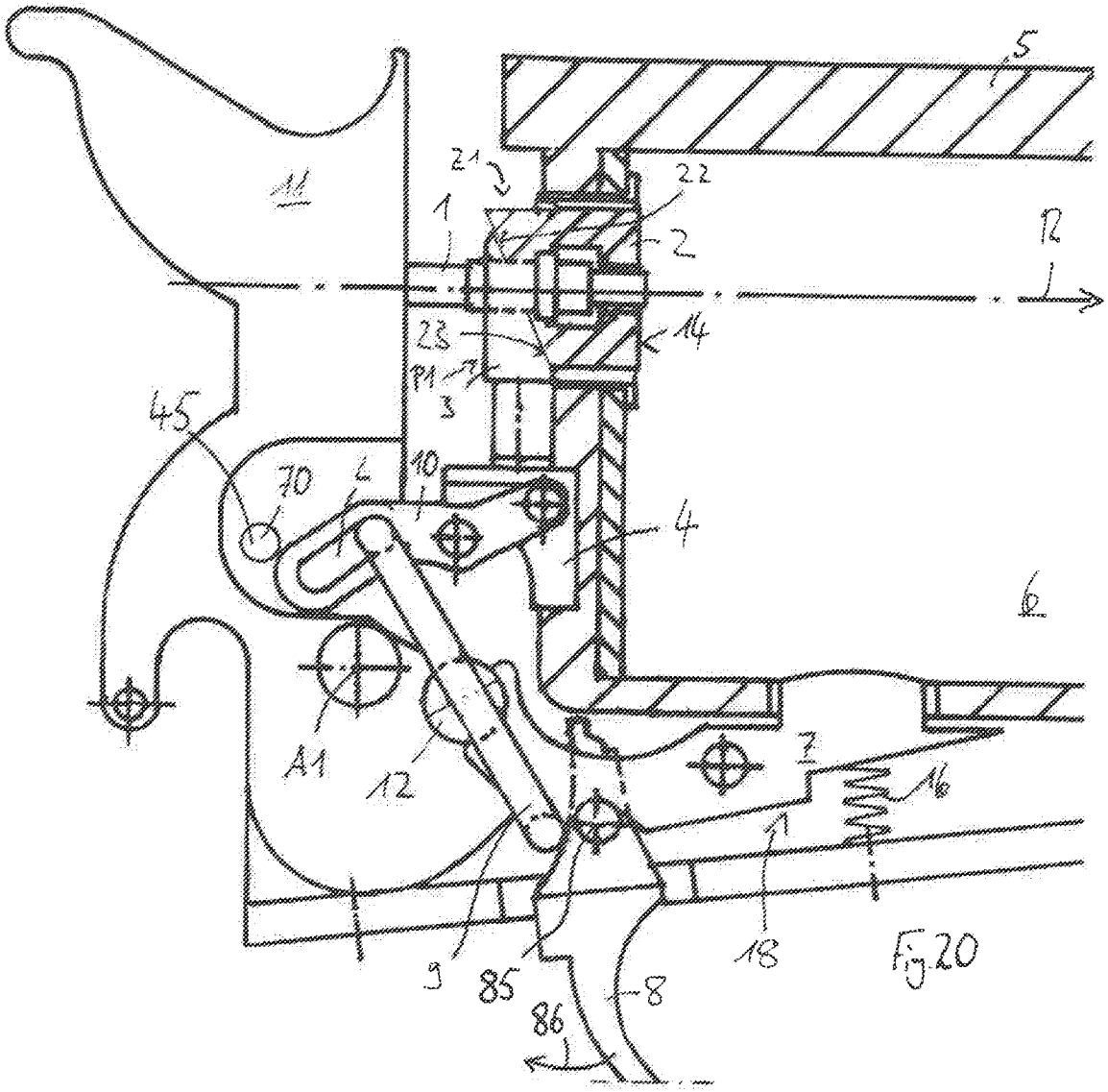
FIG. 20 shows an illustration as in FIG. 12 of a fifth exemplary embodiment and shown from the other side.

In all shown embodiments, trigger 8 can, for example, be rotatably mounted on frame 5 about an axis 85 (see, for example, FIG. 20). A trigger spring (which is not shown in the drawings) can also be provided that exerts a force on trigger 8 against the trigger actuation direction 86 (see FIG. 20).

Figures 12, 13, 13A:
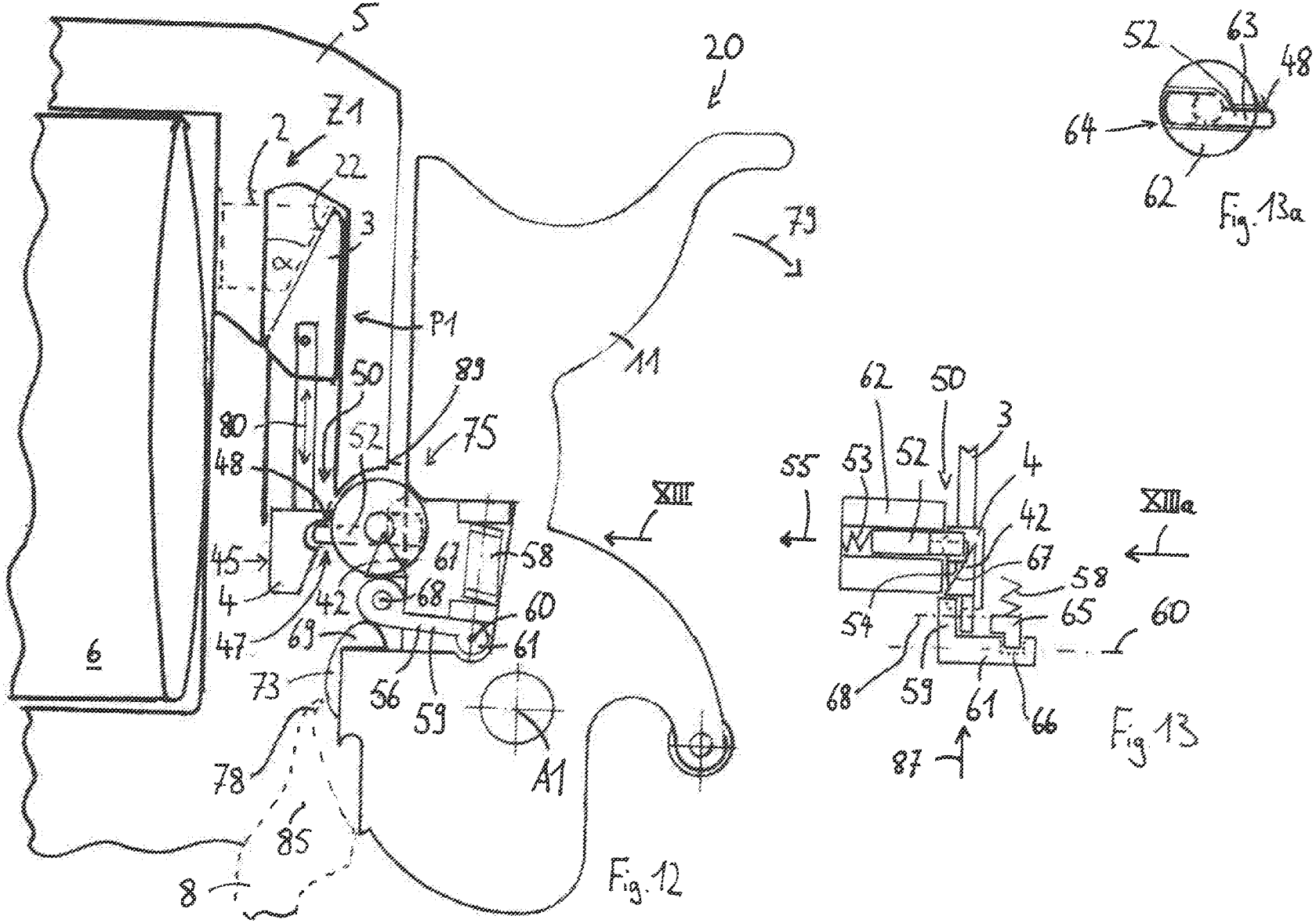
FIG. 12 shows a view as in FIG. 7 with the hammer in the neutral position, however of a fourth embodiment.
FIG. 13 shows a detail view from FIG. 12 as viewed in the direction of arrow XIII 12.
FIG. 13*a* shows a detail view from FIG. 13 as viewed in the direction of arrow XIIIa.

FIG. 12 shows a part of a fourth embodiment of a handgun according to the present invention. As in the previous embodiments, the handgun has an insert 2 provided on breechblock 14 that rests with a side opposite breechblock 14 against a support 3, which can be displaced from a first position P1, in which insert 2 is in first state Z1, into a second position P2, in which the insert is in second state Z2.

As described above, support 3 can be displaced from its first position P1 into its second position P2 and back. Angle α, which support stop surface 22 assumes with respect to displacement direction 80 of support 3, is significantly greater in the embodiments shown in FIGS. 12 to 22 than in the embodiments shown in FIGS. 1 to 11 and is approximately 25°. It follows therefrom that support 3, unlike the case of the embodiments shown in FIGS. 1 to 11, is no longer self-limited during the firing of a shot; instead, a force caused by the firing of a shot acts on support 3 in displacement direction 80 and is larger than the simultaneously acting frictional force. To absorb this force, blocking elements 45 are provided in the embodiments shown in FIGS. 12 to 22 that temporarily lock support 3 into its first position P1.

As FIGS. 12 to 13*a* show, blocking element 45 include a blocking stop 47 that can be activated and deactivated and blocking stop 45 includes a safety bolt 52 that is held in an engaged position 50 by a bolt spring 53. FIGS. 12 and 13 show safety bolt 52 from two different views, each in its engaged position 50.

Figure 7:
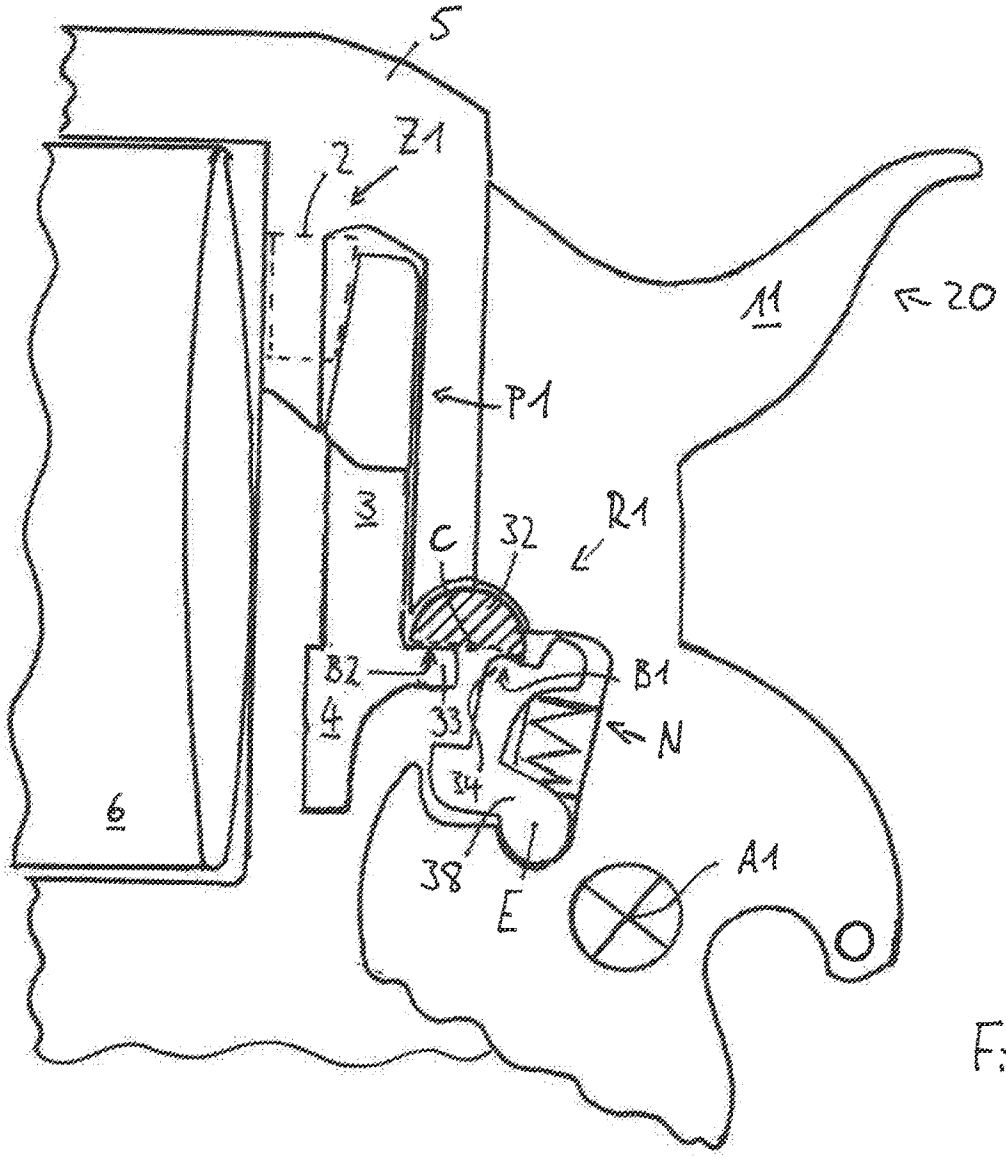
FIG. 7 shows part of a partially cut-away schematic side view of a third embodiment of a handgun according to the present invention in which the hammer is in the neutral position.

A transfer member 32, as is shown in FIG. 7, for example, is no longer present in the embodiments shown in FIGS. 12 to 22, but the displacement of support 3 is taken over by the displacement device shown in FIG. 1, namely cylinder lock 7, coupling element 9, and transfer lever 10.

An actuation projection 42 is arranged on hammer 11 in order to bring insert 2 into its second state Z2 during the loading process, which requires a displacement of support 3 in a displacement direction 80 from its first position P1 into its second position P2, meaning a deactivation of blocking stop 45, subsequently, therefore, a displacement of safety bolt 52 from its engaged position into its disengaged position. This has a bevel 67. During a tensioning of hammer 11, actuation projection 42 moves along therewith (see tensioning direction 87 in FIG. 13) and thus presses safety bolt 52 in displacement direction 55 into the disengaged position 51.

The bolt spring 53 visible in FIG. 13 presses the safety bolt back into the engaged position if hammer 11 is tensioned out of its loading position into the shooting position and support 3 is displaced using, for example, the displacement device shown in FIG. 1, is back in it first position P1.

Figure 14:
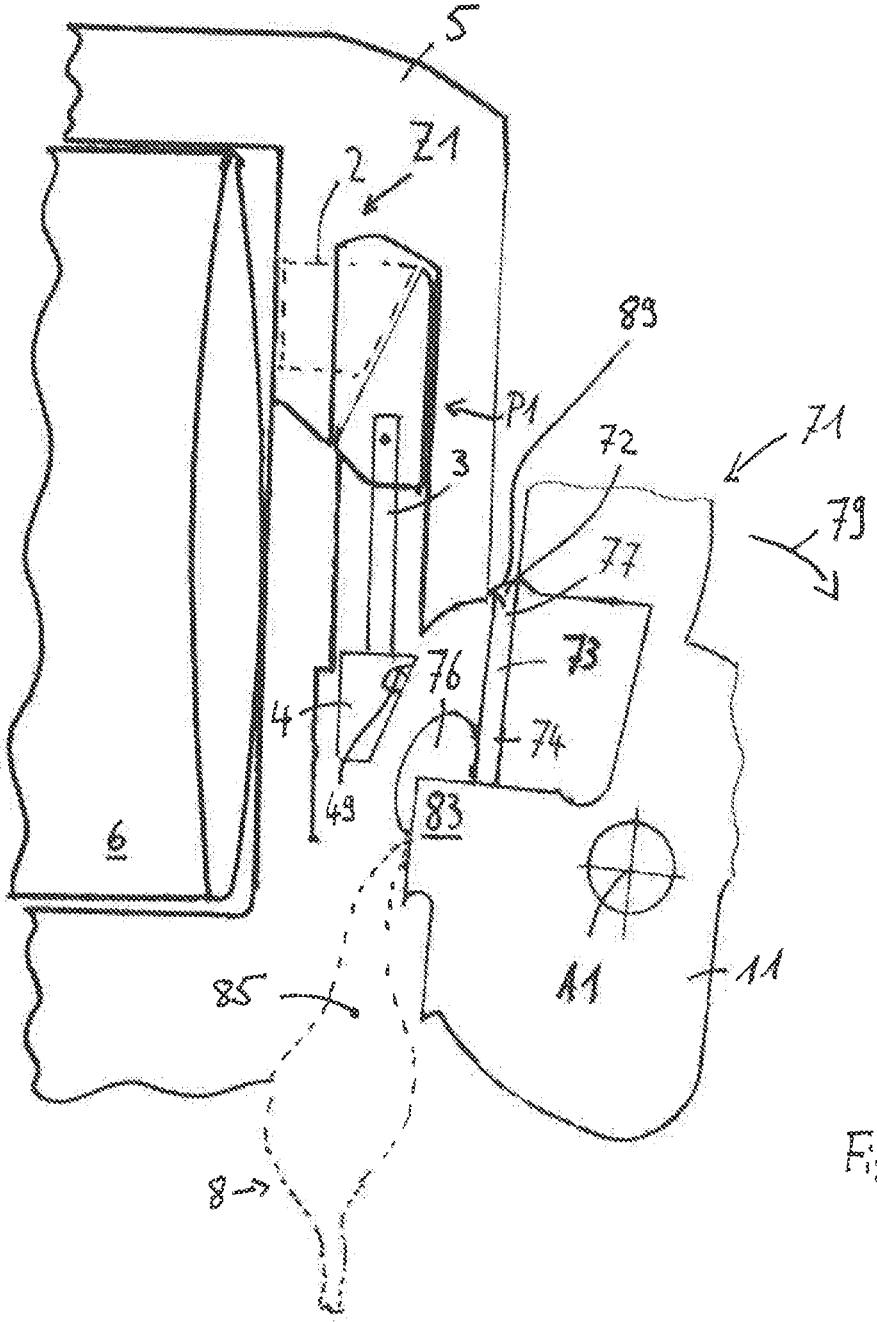
FIG. 14 shows an illustration similar to that in FIG. 12 but with a retracted, partially illustrated hammer and the sliding safety catch in the safe state.

Blocking stop 45 comprises a blocking stop surface 48 (see FIG. 13*a*) and a blocking stop counter surface 49 (see FIG. 14). The blocking stop surface can, for example, be arranged on safety bolt 52. In the engaged position of safety bolt 52, blocking stop 45 blocks support 3 by striking the blocking stop surface against the blocking stop counter surface. Blocking stop counter surface 49 can, for example, be arranged on transfer element 4 and, for example, be formed using a cut-out 54 of transfer element 4. Safety bolt 52 can be moved back and forth in a direction 55 that runs parallel to axis A1, about which hammer 11 is rotatably mounted on frame 5.

In the embodiments shown in FIGS. 12 to 20, safety bolt 52 is mounted in a receiving element 62, for example, a threaded insert that is fixedly arranged in frame 5. The receiving element 62 can, for example, be arranged in a rotationally fixed manner in frame 5, for example, by use of a screw adhesive. The receiving element 62 can, for example, have a hole in which a cylindrical section of safety bolt 52 is displaceably mounted. On its side facing support 3, safety bolt 52 in this embodiment has a transverse section 63 on the cylindrical section on which, for example, blocking stop surface 48 is arranged. Safety bolt 52 can, for example, be rotationally fixed relative to the receiving element 62, for example, in that a receiving element cut-out 64 that complements the transverse section is arranged in the receiving element 62, into which transverse section 63 is always at least partially engaged, as FIG. 13*a* shows.

Actuation projection 42 of the hammer can, for example, be designed in a manner similar to the projection of the hammer already described above in connection with a different embodiment, namely the embodiment having a transfer element.

Actuation projection 42 of hammer 11 can be displaced between a normal state 56 and a retracted state 57 relative to hammer 11 (compare, for example, FIGS. 12 and 18). This takes into account that actuation projection 42 leaves safety bolt 52 in its disengaged position during tensioning of hammer 11, whereas during the displacement of hammer 11 back from shooting position 31 into neutral position 20, actuation projection 42 must pass safety bolt 52 if the hammer is in its engaged position 50 (see, for example, FIGS. 13 and 17). A return of hammer 11 from the shooting position into the neutral position is possible in the retracted state 57 of actuation projection 42. An actuation projection spring 58 can, for example, be provided against the force of which actuation projection 42 is displaceable from its normal state 56 into its retracted state 57 and that subsequently displaces it back into its normal position. The displacement into retracted state 57 can, for example, occur automatically when safety bolt 52 passes from its shooting position into the neutral position during the displacement of the hammer.

Actuation projection 42 of hammer 11 can, for example, be arranged on an actuating lever 59, which is, for example, pivotably mounted about an axis 60 on hammer 11. Mounting axis 60 can, for example, run parallel to axis A1, about which the hammer is mounted on the frame. The actuation projection can, for example, comprise the actuating lever 59. The actuation projection 42 can be designed in one piece with the actuating lever 59. In an embodiment, the actuation projection 42 can be connected to the actuating lever 59 so as to pivot slightly. Actuating lever 59 can, for example, be loaded by actuation projection spring 58, and can, for example, be designed as a compression spring. As is shown in FIG. 13, one actuating lever 59 has a mounting region 61. In an embodiment, mounting region 61 is cylindrical and serves for the mounting of the actuating lever 59. The mounting region 61 can, for example, run approximately perpendicular to the remaining region of actuating lever 59. As FIG. 13 also shows, actuation projection spring 58 also acts on mounting region 61, namely via an angle 65. Angle 65 can, for example, have a flat surface on its side facing the mounting region. A groove 66 having a flat surface facing angle 65 can, for example, be made in mounting area 61. In normal state 56 of the actuation projection 42, the flat surface of lever 65 completely rests on the flat area of the groove. In retracted state 57, these two surfaces no longer completely rest on each other.

Figure 15:
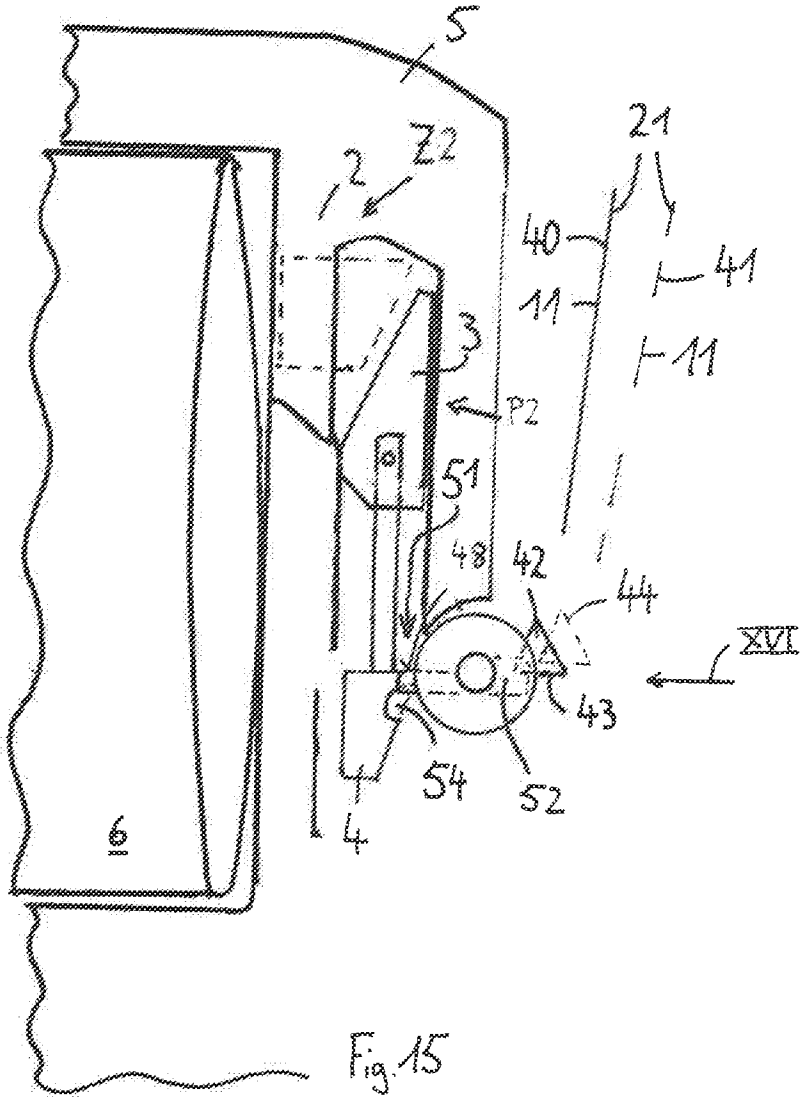
FIG. 15 shows an illustration similar to that in FIG. 12 but with the hammer symbolized only by dashed lines in the loading position.

Blocking stop 47 is designed so that it can only be activated in first position P1 of the support 3. The return of safety bolt 52 from its disengaged position into the engaged position is only possible in first position P1 of the support 3, as FIG. 15 makes clear. In FIGS. 15 and 17, hammer 11 is no longer fully illustrated for clarity's sake, but only its rotational position is shown using a solid line (FIG. 17) as well as a solid line and a dashed line (FIG. 15).

Figure 16:
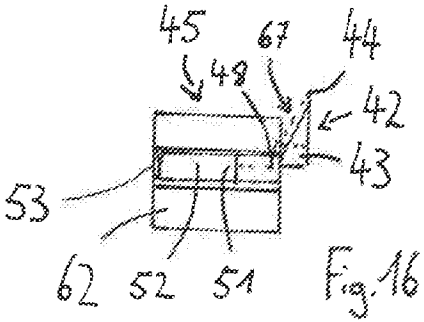
FIG. 16 shows a detail view of the safety bolt from FIG. 15 as viewed in the direction of arrow XVI in FIG. 15.

In normal state 56 of actuation projection 42, the latter can, for example, rest against a stop 69 of the hammer and is thereby, for example, locked against further rotation relative to hammer 11 in opposition to tensioning direction 79 of hammer 11. During tensioning of the hammer out of its disengaged position 51 into the loading position, actuation projection 42 pushes safety bolt 52 out of its engaged position 50 into its disengaged position (towards the left in FIG. 13). As FIGS. 15 and 16 show, actuation projection 42 is still in an initial loading position 40 of hammer 11 (shown in FIG. 15 by a solid line) on safety bolt 52. FIG. 15 also shows that, in a later loading position 41 of the hammer (shown in FIG. 15 by a dashed line), actuating projection 42 no longer rests on safety bolt 52. Position 43 of actuation projection 42 in the initial loading position is shown by a triangle and position 44 of actuation projection 42 in later loading position 41 of the hammer is shown in FIGS. 15 and 16 by a dashed line. FIG. 15 shows that safety bolt 52 is prevented from returning from its disengaged position 51 into engaged position 50 if the support 3 is still in its second position P2. Because cut-out 54 of transfer element 4 then does not overlap with safety bolt 52. As soon as support 3 moves back into its first position P1, as occurs during a tensioning of hammer 11 into its shooting position 31 and as is shown in FIG. 17, safety bolt 52 is pressed by its bolt spring 53 into engaged position 50. FIG. 17 also shows position 46 of actuation projection 42 in a shooting position as a dashed triangle.

Figure 19:
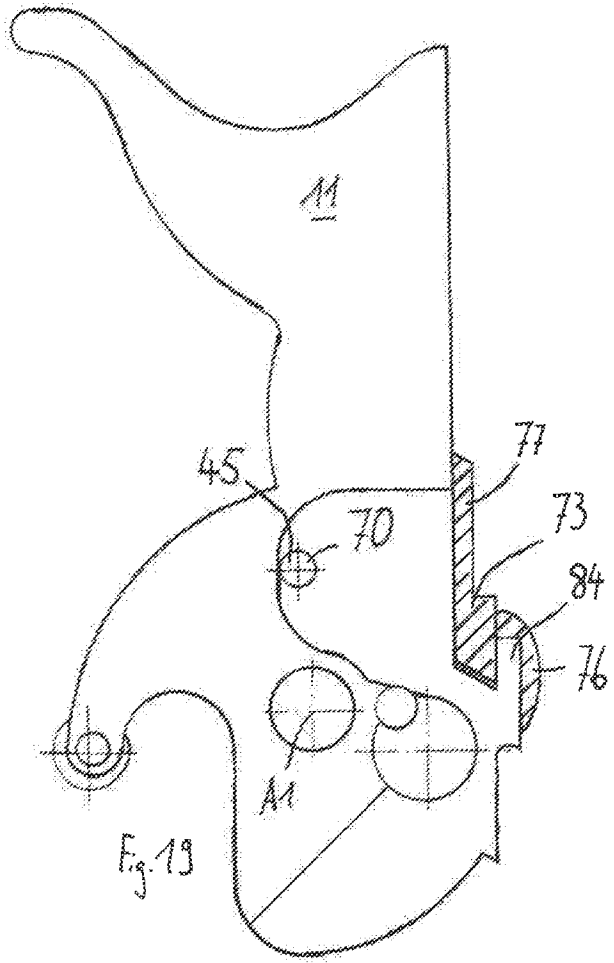
FIG. 19 shows an illustration of the hammer from FIG. 12, however, from the other side, as shown in FIG. 12, and having the sliding safety catch shaded.

FIGS. 19 and 20 show additional blocking elements 45. These can be provided additionally or alternatively to the blocking elements 45 described above. The blocking elements shown in FIG. 20 include a locking pin 70 that is arranged on hammer 11 and transfer lever 10 that is in its neutral position and which thereby blocks support 3. As soon as the hammer 11 is tensioned out of its neutral position, locking pin 70 no longer blocks transfer lever 10 and no longer prevents support 3 from being displaced from its first position P1 into its second position P2.

The embodiment shown in FIG. 20 differs from the embodiment shown in FIGS. 12 to 19 only in that individual parts are formed in a slightly different manner.

As FIG. 14, in particular, shows, the gun can be brought into a locked state 71 in which hammer 11 is prevented from displacement into its neutral position 20. In the locked state of the gun, a retaining stop 72 can, for example, be activated that prevents the hammer 11 from displacement into its neutral position. Retaining stop 72 is arranged between the hammer 11 and frame 5 of the gun in the locked state. Retaining stop 72 can, for example, be designed as a sliding safety catch 73. The sliding safety catch 73 can, for example, be slidably mounted on hammer 11. The sliding safety catch 73 can, for example, be brought into a safe state 74 and a release state 75 (compare FIG. 14 and FIG. 12). The sliding safety catch 73 has an actuation region 76 and a stop region 77. In neutral position of the hammer 11, sliding safety catch 73 is in its release state 75. In this state, trigger 8 rests with its projection 78 on actuation region 76 of the sliding safety catch 73. Retaining stop 72 is activated by a tensioning of the hammer 11 a few degrees, for example, about 10°, and subsequent relief of the hammer 11, by release of the hammer 11, for example. This can, for example, be accomplished by projection 78 of the trigger sliding along the actuation region of sliding safety catch 76 until it comes to rest against actuation region 76 below it. Safety bolt 52 is thus not, or not significantly, displaced. It is also in principle possible for actuation region 76 of the sliding safety catch 73 to have a notch into which projection 78 of the trigger can be engaged. If hammer 11 is thereafter released, it is then displaced back against tension direction 79 because of tension spring 17 (see FIG. 4) that acts upon it. In any case, it does not displace back fully into its neutral position. This is because projection 78 of the trigger remains in contact with actuation region 76 of the sliding safety catch 73 during this return displacement of hammer 11 and prevents sliding safety catch 73 from shifting back with hammer 11 without a movement relative thereto. Instead, a movement of sliding safety catch 73 relative to the hammer 11 occurs and the former is pushed from its release position 75 into its safe state 74 (towards the top in FIG. 12), whereby retaining stop 72 is activated. In this safe state 74, shown in FIG. 14, stop region 77 of sliding safety catch 73 prevents a displacement of hammer 11 into its neutral position, for example, by contacting a counter stop surface 89 of the frame, and thus provides retaining stop 72. The gun is secured against accidental firing in this situation. If hammer 11 is tensioned out of this safe position in the direction of tensioning direction 79, projection 78 of the trigger then ends up being out of contact with the sliding safety catch and, for example, slides along hammer 11. As FIG. 12 shows, for example, sliding safety catch 73 provides stop 69 against which actuation projection 42 rests in its normal state 56 with actuation lever 59. After projection 78 of the trigger is no longer in contact with sliding safety catch 73, the latter is then displaced back into release state 75 by actuation lever 56, which is loaded by actuation projection spring 58. Retaining stop 72 is then no longer activated and no longer obstructs a displacement of the hammer 11 into the neutral position and with it the firing of a shot.

In FIG. 19, sliding safety catch 73, displayed as hatched, can also clearly be seen. The sliding safety catch 73 is designed as one piece in the shown embodiment. In FIG. 19, actuation region 76 of the sliding safety catch is farther away from the viewer than stop region 77. Actuation region 76 is guided between guide regions 83, 84 of hammer 11 (see FIGS. 14 and 19).

Figure 21:
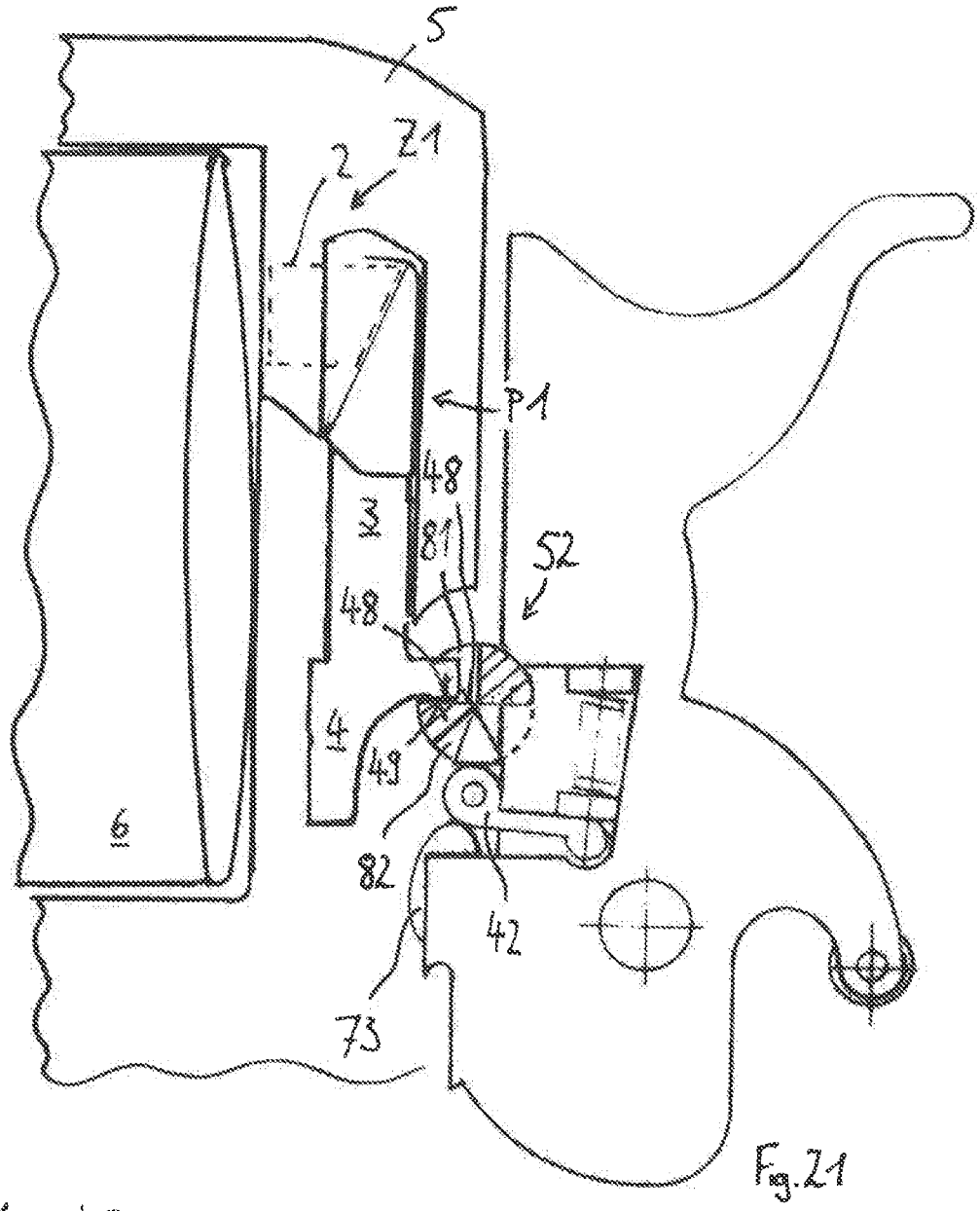
FIG. 21 shows an illustration as in FIG. 12 of a sixth exemplary embodiment.
Figure 22:
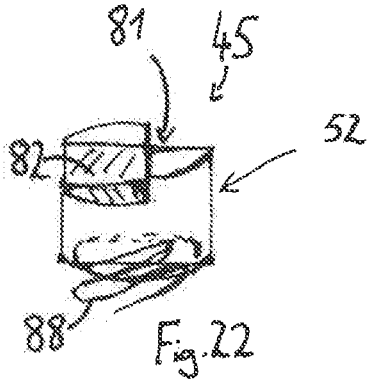
FIG. 22 shows a perspective representation of the sliding safety catch from FIG. 21.

FIGS. 21 and 22 show a sixth embodiment in which safety bolt 52 is displaceably arranged directly in a hole of frame 5. Safety bolt 52 in this embodiment has a cylindrical base shape. On its side facing support 3, it has a cut-out 81 for forming a stop surface 48. It is arranged in a rotationally locked manner in frame 5 by a rotational lock (not shown in the drawings) which can be designed like rotation lock 25 of the carrier stop shown in FIGS. 2 and 3, and provided with a bolt spring 88. In the shown embodiment, it has an additional cut-out 82 on its side facing support 3 in order to create space for actuation projection 42 and/or to provide an appropriate contact surface therefor.

The present invention is not limited to embodiments described herein; reference should be had to the appended claims.

LIST OF REFERENCE NUMERALS

100 Handgun
1 Firing pin
2 Breechblock insert
3 Support
4 Transfer element
5 Frame
6 Cylinder
7 Cylinder lock
8 Trigger
9 Coupling element
10 Transfer lever
11 Hammer
12 Carrier stop
13 Barrel
14 Breechblock
15 Stop spring
16 Locking spring
17 Tension spring
18 Locked position of the cylinder lock
19 Release position of the cylinder lock
20 Neutral position of the hammer
21 Loading position of the hammer
22 Supporting stop surface
23 Supporting stop counter surface
24 Carrier stop bevel
25 Carrier stop rotation lock
26 Cartridge
27 Cartridge base
28 Retaining stop
29 Cylinder lock counter-stop surface
30 Retaining counter-stop surface
31 Shooting position of the hammer
32 Transfer element
32*a* Cylindrical region of the transfer element
32*b* Semi-cylindrical region of the transfer element
33 Projection on the movable supporting element
34 Hammer projection
35 Cylinder carrier
36 Cylinder carrier stop surface
37 Support shoulder
38 Lever
39 Projection spring
40 Initial loading position of the hammer
41 Subsequent loading position of the hammer
42 Actuation projection
43 Position of the actuation projection in the initial loading position
44 Position of the actuation projection in the subsequent loading position
45 Blocking element
46 Position of the actuation projection in the shooting position of the hammer
47 Blocking stop
48 Blocking stop surface
49 Blocking stop counter surface
50 Engaged position of the safety bolt
51 Disengaged position of the safety bolt
52 Safety bolt
53 Bolt spring
54 Cut-out
55 Displacement direction of the safety bolt
56 Normal state of the actuation projection
57 Retracted state of the actuation projection
58 Actuation projection spring
59 Actuating lever
60 Mounting axis of the actuating lever
61 Mounting region of the actuating lever
62 Receiving element
63 Transverse section
64 Receiving element cut-out
65 Angle
66 Groove
67 Actuation projection bevel
68 Axis
69 Hammer stop
70 Locking pin
71 Safe state
72 Retaining stop
73 Sliding safety catch
74 Safe state of the sliding safety catch
75 Release state of the sliding safety catch
76 Actuation region of the sliding safety catch
77 Stop region of the sliding safety catch
78 Trigger projection
79 Tensioning direction of the hammer
80 Displacement direction of the support
81 Sliding safety catch cut-out
82 Additional safety bolt cut-out
83 Guide region of the hammer
84 Guide region of the hammer
85 Trigger axis
86 Trigger actuation direction
87 Tensioning direction
88 Bolt spring
89 Retaining counter-stop surface
α Angle
A1, A2, A3 Axes of rotation
B1 First region of the transfer element
B2 Second region of the transfer element
C Transfer element axis of rotation
D Cylinder carrier stop surface axis of rotation
E Lever pivot axis
K1, K2 Notches
L Elongated hole
N Normal state of the lever projection
P1 First position of the support
P2 Second position of the support
R Longitudinal extension of the barrel
R1 First rotational position of the transfer element R2 Second rotational position of the transfer element
S Play
U Retracted state of the lever actuating projection
Z1 First state of the insert
Z2 Second state of the insert

What is claimed is:

1. A handgun comprising:
a frame;
a barrel which is configured to extend in a longitudinal direction;
a breechblock insert comprising a breechblock;
a hammer configured to be displaceable; and
a wedge shaped support which is configured to be movable relative to the breechblock insert via a displacement of the hammer, the wedge shaped support being supported in the frame against a displacement in the direction facing away from the breechblock insert,
wherein,
the breechblock insert is configured,
to be brought from a first state into a second state via the hammer where, in the first state, the breechblock insert has no play in the longitudinal direction of the barrel and thereby supports a shell casing during a shot, and, in the second state, the breechblock insert has a play which is greater than the no play of the breechblock insert in the first state, and
to engage with the wedge shaped support,
the play and the no play of the breechblock insert is performed by a movement of the wedge shaped support perpendicular to the longitudinal direction of the barrel, and
any bracing between a shell casing and the breechblock is released by providing the play in the second state so as to simplify a reloading.

2. The handgun as recited in claim 1, wherein the breechblock insert is further configured so that,
in the second state, the play of the breechblock insert in the longitudinal direction of the barrel that is less than 1 mm.

3. The handgun as recited in claim 1, wherein,
the hammer is manually displaceable from a neutral position into a loading position, and from the loading position into a shooting position,
the wedge shaped support is configured to be moved via the manual displacement of the hammer, and
the breechblock insert is further configured to rest against the wedge shaped support at a side which is opposite to the breechblock.

4. The handgun as recited in claim 3, wherein the handgun further comprises:
a cylinder;
a cylinder lock;
a coupling element;
a transfer lever; and
a carrier stop,
wherein,
a movement of the coupling element is transferable onto the wedge shaped support,
a movement of the cylinder lock and transfer lever are coupled via the coupling element, and
the carrier stop is configured so that, during the manual displacement of the hammer from the neutral position into the loading position, the carrier stop displaces the cylinder lock from a locked position into a free position, whereby the transfer lever moves the wedge shaped support from a first position, in which the breechblock insert is in the first state, into a second position, in which the breechblock insert is in the second state.

5. The handgun as recited in claim 4, further comprising:
a transfer element which is configured to transfer or convert the manual displacement of the hammer from the neutral position into the loading position on the wedge shaped support so that the wedge shaped support is thereby moved from the first position, in which the breechblock insert is in the first state, into the second position, in which the breechblock insert is in the second state.

6. The handgun as recited in claim 5, wherein,
the hammer comprises a projection,
the wedge shaped support comprises a projection,
the transfer element comprises a first region, a second region, and an axis, wherein, the transfer element is,
rotatably mounted about the axis,
arranged to abut the projection of the hammer with the first region,
to abut the projection of the wedge shaped support with the second region, and
to rotate about the axis via the manual displacement of the hammer to thereby displace the projection of the wedge shaped support with the second region.

7. The handgun as recited in claim 6, wherein the transfer element further comprises a cylindrical region comprising the axis and an at least semi-cylindrical region on which the first region and the second region are arranged.

8. The handgun as recited in claim 6, further comprising:
a lever comprising an axis,
wherein,
the projection of the hammer is arranged on the lever, and
the lever is pivotably mounted about the axis on the hammer.

9. The handgun as recited in claim 1, further comprising:
a blocking element,
wherein,
the breechblock insert, on the side opposite to the breechblock, rests against the wedge shaped support,
the wedge shaped support is configured to be moved from a first position, in which the breechblock insert is in the first state, into a second position, in which the breechblock insert is in the second state, and
the blocking element is configured to temporarily lock the wedge shaped support in the first position.

10. The handgun as recited in claim 9, wherein the blocking element comprises a blocking stop which is configured to be activated and deactivated.

11. The handgun as recited in claim 10, further comprising:
a bolt spring;
wherein,
the hammer comprises an actuation projection,
the blocking stop comprises a safety bolt which is configured to be displaced into an engaged position and into a disengaged position,
the safety bolt is held by the bolt spring in the engaged position, and
the actuation projection arranged on the hammer is configured to displace the safety bolt into the disengaged position when the hammer is tensioned.

12. The handgun as recited in claim 1, wherein,
the hammer is manually displaceable from a neutral position into a loading position, and from the loading position into a shooting position, and the handgun is configured to be brought into a safe state in which the hammer is prevented from a displacement into the neutral position.

13. The handgun as recited in claim 1, wherein, the hammer is manually displaceable from a neutral position into a loading position, and from the loading position into a shooting position, the hammer comprising a cylinder carrier arranged thereon, the wedge shaped support comprises a shoulder, the breechblock insert is further configured to rest against the wedge shaped support on a side which is opposite to the breechblock, the cylinder carrier arranged on the hammer is rotatably mounted about an axis comprising a stop surface so that, during the manual displacement of the hammer from the loading position into the shooting position, the cylinder carrier moves the wedge shaped support from a second position, in which the breechblock insert is in the second state, into a first position, in which the breechblock insert is in the first state, and the cylinder carrier presses against the shoulder of the wedge shaped support with the stop surface during the manual displacement of the hammer from the loading position into the shooting position.

14. The handgun as recited in claim 1, further comprising:

a cylinder;

a cylinder lock;

a stop spring; and a carrier stop arranged on and being rotationally dependent on the hammer, the carrier stop being configured to be displaceable relative to the hammer against a force of the stop spring, and to transfer a tensioning of the hammer from a neutral position into a loading position to the cylinder lock so that the cylinder lock is displaced from a locked position into a free position.

* * * * *